US006232582B1

(12) United States Patent
Minnear et al.

(10) Patent No.: US 6,232,582 B1
(45) Date of Patent: May 15, 2001

(54) OVEN AND METHOD OF COOKING THEREWITH BY DETECTING AND COMPENSATING FOR VARIATIONS IN LINE VOLTAGE

(75) Inventors: William Minnear, Clifton, NY (US); John O'Neill, Burlingame, CA (US); Chris Tatarian, San Bruno, CA (US); Don Pettibone, Cupertino, CA (US)

(73) Assignee: Quadlux, Inc., Fremont, CA (US)

( * ) Notice: Subject to any disclaimer, the term of this patent is extended or adjusted under 35 U.S.C. 154(b) by 0 days.

(21) Appl. No.: 09/291,684

(22) Filed: Apr. 13, 1999

Related U.S. Application Data

(60) Provisional application No. 60/081,694, filed on Apr. 14, 1998.

(51) Int. Cl.[7] ..... H05B 1/02

(52) U.S. Cl. ..... 219/497; 219/481; 219/492; 99/328

(58) Field of Search ..... 219/492, 493, 219/497, 501, 505, 481; 323/234, 235; 99/328, 342, 325

(56) References Cited

U.S. PATENT DOCUMENTS

| | | | | |
|---|---|---|---|---|
| 4,223,207 | | 9/1980 | Chow | 219/494 |
| 4,843,202 | | 6/1989 | Smith | 219/10.55 B |
| 4,851,635 | | 7/1989 | Farrow | 219/110 |
| 5,079,410 | * | 1/1992 | Payne et al. | 219/506 |
| 5,310,984 | | 5/1994 | Ratledge et al. | 219/110 |
| 5,844,207 | | 12/1998 | Allard et al. | 219/497 |
| 5,948,305 | * | 9/1999 | Petrides et al. | 219/519 |
| 5,990,460 | * | 11/1999 | Petty et al. | 219/497 |

* cited by examiner

*Primary Examiner*—Mark Paschall
(74) *Attorney, Agent, or Firm*—George C. Limbach

(57) ABSTRACT

A cooking oven and method which compensates for variations in line voltage so as to achieve uniform cooking results that are independent of line voltage. The method includes providing an oven having a radiant energy source mounted therein, initiating a selected cooking cycle in the oven, measuring the line voltage across the radiant energy source and determining the increase or decrease in the line voltage above or below a predetermined nominal value. An adjusted energization time is determined relative to the predetermined energization time, using the determined increase or decrease in line voltage. The cooking cycle is completed using the adjusted energization time.

10 Claims, 19 Drawing Sheets

OVEN AND METHOD OF COOKING THEREWITH BY DETECTING AND COMPENSATING FOR VARIATIONS IN LINE VOLTAGE

The application claims the benefit of U.S. Provisional Application Ser. No. 60/081,694, filed Apr. 14, 1998.

FIELD OF THE INVENTION

This invention relates to the field of cooking ovens and methods, including those using radiant energy in the infrared, near-visible and visible ranges of the electromagnetic spectrum. More particularly, this invention relates to apparatuses and methods for modifying lightwave cooking recipes to compensate for variations in the line voltage being applied across the cooking lamps.

BACKGROUND OF THE INVENTION

Ovens for cooking and baking food have been known and used for thousands of years. Basically, oven types can be categorized in four cooking forms; conduction cooking, convection cooking, infrared radiation cooking and microwave radiation cooking.

There are subtle differences between cooking and baking. Cooking just requires the heating of the food. Baking of a product from a dough, such as bread, cake, crust, or pastry, requires not only heating of the product throughout but also chemical reactions coupled with driving the water from the dough in a predetermined fashion to achieve the correct consistency of the final product and finally browning the outside. Following a recipe when baking is very important. An attempt to decrease the baking time in a conventional oven by increasing the temperature results in a damaged or destroyed product.

In general, there are problems when one wants to cook or bake foodstuffs with high-quality results in the shortest times. Conduction and convection provide the necessary quality, but both are inherently slow energy transfer methods. Long-wave infrared radiation can provide faster heating rates, but it only heats the surface area of most foodstuffs, leaving the internal heat energy to be transferred by much slower conduction. Microwave radiation heats the foodstuff very quickly in depth, but during baking the loss of water near the surface stops the heating process before any satisfactory browning occurs. Consequently, microwave ovens cannot produce quality baked foodstuffs, such as bread.

Radiant cooking methods can be classified by the manner in which the radiation interacts with the foodstuff molecules. For example, starting with the longest wavelengths for cooking, the microwave region, most of the heating occurs because the radiant energy couples into the bipolar water molecules causing them to rotate. Viscous coupling between water molecules converts this rotational energy into thermal energy, thereby heating the food. Decreasing the wavelength to the long-wave infrared regime, the molecules and their component atoms resonantly absorb the energy in well-defined excitation bands. This is mainly a vibrational energy absorption process. In the shortwave infrared region of the spectrum, the main part of the absorption is due to higher frequency coupling to the vibrational modes. In the visible region, the principal absorption mechanism is excitation of the electrons that couple the atoms to form the molecules. These interactions are easily discerned in the visible band of the spectra, where they are identified as "color" absorptions. Finally, in the ultraviolet, the wavelength is short enough, and the energy of the radiation is sufficient to actually remove the electrons from their component atoms, thereby creating ionized states and breaking chemical bonds. This short wavelength, while it finds uses in sterilization techniques, probably has little use in foodstuff heating, because it promotes adverse chemical reactions and destroys food molecules.

Lightwave ovens are capable of cooking and baking food products in times much shorter than conventional ovens. This cooking speed is attributable to the range of wavelengths and power levels that are used.

There is no precise definition for the visible, near visible and infrared ranges of wavelengths because the perceptive ranges of each human eye is different. Scientific definitions of the "visible" light range, however, typically encompass the range of about 0.39 $\mu$m to 0.77 $\mu$m. The term "near-visible" has been coined for infrared radiation that has wavelengths longer than the visible range, but less than the water absorption cut-off at about 1.35 $\mu$m. The term "infrared" refers to wavelengths greater than about 1.35 $\mu$m. For the purposes of this disclosure, the visible region includes wavelengths between about 0.39 $\mu$m and 0.77 $\mu$m, the near-visible region includes wavelengths between about 0.77 $\mu$m and 1.35 $\mu$m, and the infrared region includes wavelengths greater than about 1.35 $\mu$m.

Typically, wavelengths in the visible range (0.39 to 0.77 $\mu$m) and the near-visible range (0.77 to 1.35 $\mu$m) have fairly deep penetration in most foodstuffs. This range of deep penetration is mainly governed by the absorption properties of water. The characteristic penetration distance for water varies from about 50 meters in the visible to less than about 1 mm at 1.35 microns. Several other factors modify this basic absorption penetration. In the visible region electronic absorption of the food molecules reduces the penetration distance substantially, while scattering in the food product can be a strong factor throughout the region of deep penetration. Measurements show that the typical average penetration distances for light in the visible and near-visible region of the spectrum varies from 2–4 mm for meats to as deep as 10 mm in some baked goods and liquids like non-fat milk.

The region of deep penetration allows the radiant power density that impinges on the food to be increased, because the energy is deposited in a fairly thick region near the surface of the food, and the energy is essentially deposited in a large volume, so that the temperature of the food at the surface does not increase rapidly. Consequently the radiation in the visible and near-visible regions does not contribute greatly to the exterior surface browning.

In the region above 1.35 $\mu$m (infrared region), the penetration distance decreases substantially to fractions of a millimeter, and for certain absorption peaks down to 0.001 mm. The power in this region is absorbed in such a small depth that the temperature rises rapidly, driving the water out and forming a crust. With no water to evaporate and cool the surface the temperature can climb quickly to 300° F. This is the approximate temperature where the set of browning reactions (Maillard reactions) are initiated. As the temperature is rapidly pushed even higher to above 400° F. the point is reached where the surface starts to burn.

It is the balance between the deep penetration wavelengths (0.39 to 1.35 $\mu$m) and the shallow penetration wavelengths (1.35 $\mu$m and greater) that allows the power density at the surface of the food to be increased in the lightwave oven, to cook the food rapidly with the shorter wavelengths and to brown the food with the longer infrared so that a high-quality product is produced. Conventional ovens do not have the shorter wavelength components of radiant energy. The resulting shallower penetration means that increasing the radiant power in such an oven only heats the food surface faster, prematurely browning the food before its interior gets hot.

It should be noted that the penetration depth is not uniform across the deeply penetrating region of the spectrum. Even though water shows a very deep penetration for visible radiation, i.e., many meters, the electronic absorptions of the food macromolecules generally increase in the visible region. The added effect of scattering near the blue end (0.39 $\mu$m) of the visible region reduces the penetration even further. However, there is little real loss in the overall average penetration because very little energy resides in the blue end of the blackbody spectrum.

Conventional ovens operate with radiant power densities as high as about 0.3 W/cm$^2$ (i.e. at 400° F.). The cooking speeds of conventional ovens cannot be appreciably increased simply by increasing the cooking temperature, because increased cooking temperatures drive water off the food surface and cause browning and searing of the food surface before the food's interior has been brought up to the proper temperature. In contrast, lightwave ovens have been operated from approximately 0.8 to 5 W/cm$^2$ of visible, near-visible and infrared radiation, which results in greatly enhanced cooking speeds. The lightwave oven energy penetrates deeper into the food than the radiant energy of a conventional oven, thus cooking the food interior faster. Therefore, higher power densities can be used in a lightwave oven to cook food faster with excellent quality. For example, at about 0.7 to 1.3 W/cm$^2$, the following cooking speeds have been obtained using a lightwave oven:

| Food | Cook Time |
|---|---|
| pizza | 4 minutes |
| steaks | 4 minutes |
| biscuits | 7 minutes |
| cookies | 11 minutes |
| vegetables (asparagus) | 4 minutes |

For high-quality cooking and baking, applicants have found that a good balance ratio between the deeply penetrating and the surface heating portions of the impinging radiant energy is about 50:50, i.e., Power(0.39 to 1.35 $\mu$m)/Power(1.35 $\mu$m and greater)≈1. Ratios higher than this value can be used, and are useful in cooking especially thick food items, but radiation sources with these high ratios are difficult and expensive to obtain. Fast cooking can be accomplished with a ratio substantially below 1, and it has been shown that enhanced cooking and baking can be achieved with ratios down to about 0.5 for most foods, and lower for thin foods, e.g., pizza and foods with a large portion of water, e.g., meats. Generally the surface power densities must be decreased with decreasing power ratio so that the slower speed of heat conduction can heat the interior of the food before the outside burns. It should be remembered that it is generally the burning of the outside surface that sets the bounds for maximum power density that can be used for cooking. If the power ratio is reduced below about 0.3, the power densities that can be used are comparable with conventional cooking and no speed advantage results.

If blackbody sources are used to supply the radiant power, the power ratio can be translated into effective color temperatures, peak intensities, and visible component percentages. For example, to obtain a power ratio of about 1, it can be calculated that the corresponding blackbody would have a temperature of 3000° K, with a peak intensity at 0.966 $\mu$m and with 12% of the radiation in the full visible range of 0.39 to 0.77 $\mu$m. Tungsten halogen quartz bulbs have spectral characteristics that follow the blackbody radiation curves fairly closely. Commercially available tungsten halogen bulbs have successfully been used with color temperatures as high as 3400° K. Unfortunately, the lifetime of such sources falls dramatically at high color temperatures (at temperatures above 3200° K it is generally less that 100 hours). It has been determined that a good compromise in bulb lifetime and cooking speed can be obtained for tungsten halogen bulbs operated at about 2900–3000° K. As the color temperature of the bulb is reduced and more shallow-penetrating infrared is produced, the cooking and baking speeds are diminished for quality product. For most foods there is a discernible speed advantage down to about 2500° K (peak at about 1.2 $\mu$m; visible component of about 5.5%) and for some foods there is an advantage at even lower color temperatures. In the region of 2100° K the speed advantage vanishes for virtually all foods that have been tried.

For rectangular-shaped commercial lightwave ovens using polished, high-purity aluminum reflective walls, it has been determined that about 4 kilowatts of lamp power is necessary for a lightwave oven to have a reasonable cooking speed advantage over a conventional oven. Four kilowatts of lamp power can operate four commercially available tungsten halogen lamps, at a color temperature of about 3000° K, to produce a power density of about 0.6–1.0 W/cm$^2$ inside the oven cavity. This power density has been considered near the minimum value necessary for the lightwave oven to clearly outperform a conventional oven. Such commercial lightwave ovens can have lamps both above and below the cooking surface so that the foodstuff on the cooking surface is cooked relatively evenly.

In some appliances such as lightwave ovens, variations in line voltage can negatively impact performance of the appliance. Line voltages tend to differ between different geographic locations and will also be different for a single location at different times of the day. It has been found that the normal variations in line voltage can affect cooking quality in lightwave ovens because they affect the average cooking power being used in the oven. It is therefore desirable to provide an oven and cooking method that detects line voltage and compensates for variations in order to achieve uniform cooking results.

SUMMARY OF THE INVENTION

A cooking oven and method which compensates for variations in line voltage so as to achieve uniform cooking results that are independent of line voltage. The method includes providing an oven having a radiant energy source mounted therein, initiating a selected cooking cycle in the oven, measuring the line voltage across the radiant energy source and determining the increase or decrease in the line voltage above or below a predetermined nominal value. An adjusted energization time is determined relative to the predetermined energization time, using the determined increase or decrease in line voltage. The cooking cycle is completed using the adjusted energization time.

DETAILED DESCRIPTION OF THE DRAWINGS

An apparatus and method for cooking while compensating for fluctuations in line voltage will be described with respect to lightwave oven 100, 201 of the types shown in FIGS. 1 through 8C. It should be understood, however, that the disclosed line voltage compensation scheme is suitable for use in connection with numerous lightwave oven configurations. Such other ovens include, but are not limited to, those described in the following published applications: International Appl. No. PCT/US92/06266, entitled COOKING APPARATUS USING ELECTRON AND MOLECULAR EXCITATION MODE; and International Appl. No. PCT/US96/06485, entitled LIGHTWAVE OVEN USING HIGHLY REFLECTIVE SURFACE MATERIALS, each of which is incorporated herein by reference. Moreover, the compensation scheme is further suitable for use outside the lightwave cooking area, such as in microwave ovens or other appliances in which average power utilized by the appliance is critical to the performance of the appliance.

Figure 1:
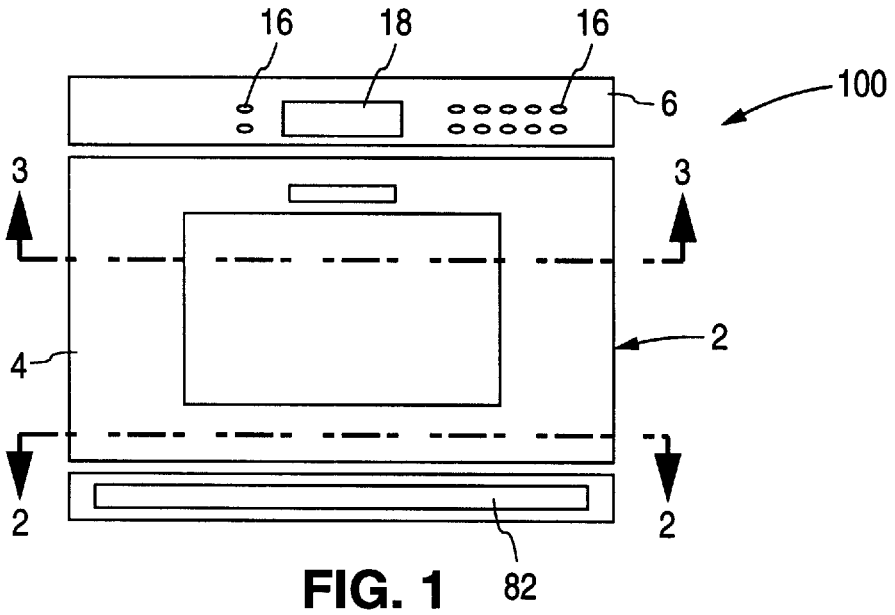
FIG. 1 is a front elevation view of a first lightwave oven suitable for use in connection with the present invention.

The lightwave oven 100 of FIGS. 1–4 includes a rectangular housing 2, a door 4, a control panel 6, a power supply 7, an oven cavity 8, and a controller 9. Referring to FIG. 1, control panel 6 is connected to controller 9. The control panel contains several operation keys 16 for controlling the lightwave oven and a display 18 indicating such information as the user input, mode of operation, remaining cook time, etc.

Figure 2:
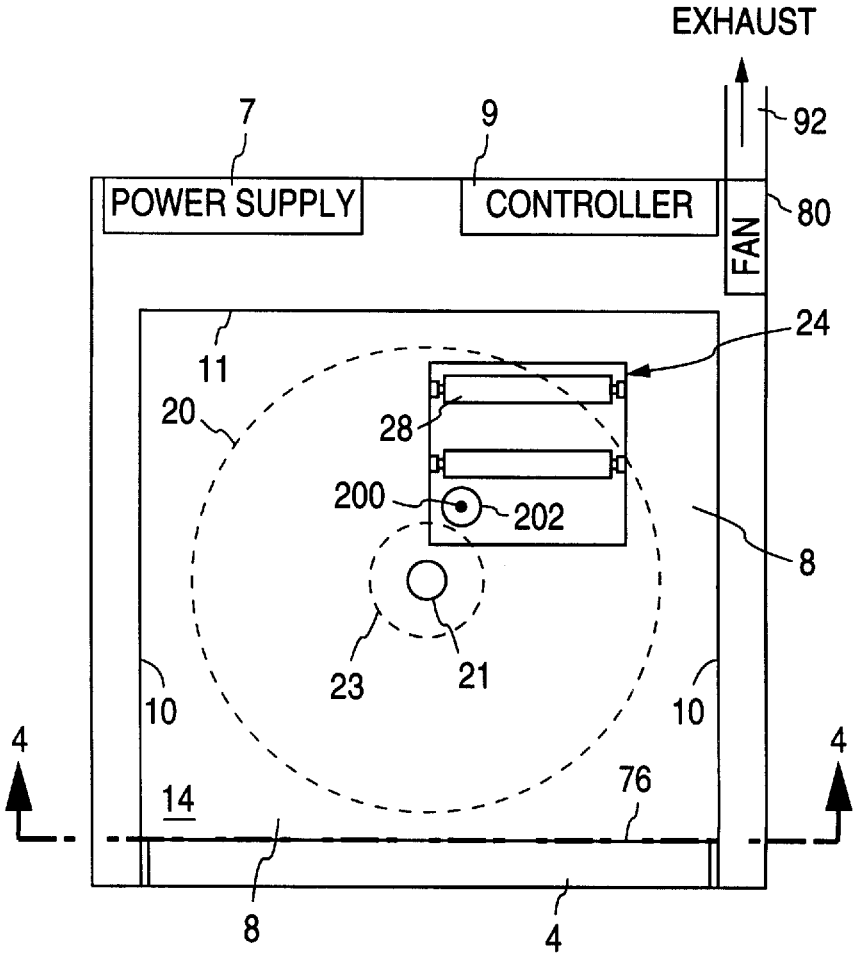
FIG. 2 is a cross-sectional bottom view of the lightwave oven of FIG. 1, showing the lower interior surface of the oven.

Referring to FIG. 2, the oven cavity 8 includes interior sidewalls 10, rear wall 11, top wall 12 (FIG. 3), and bottom wall 14. The door 4 forms a front wall and is moveable between opened and closed positions.

A turntable 20 (shown in dashed lines in FIG. 2 to permit viewing of the underlying components) is mounted on a centrally located pedestal 21 extending from the bottom wall 14. Pedestal 21 is coupled to a motor 23 positioned beneath the wall 14, which causes rotation of the turntable 20 during use. The turntable 20 is preferably detachable to provide the user with turntables of differing reflectivities depending on the cooking application. For example, the turntable may be a black or other dark color pan, a radiation transparent glass or glass-ceramic pan, or a wire grill.

A lower reflector/lamp assembly 24 is mounted within the bottom wall 14. A pair of 1000 W lamps 28 are mounted within the assembly 24 and extend towards the side walls 10. Each lamp 28 has an overall length of approximately 7.5 inches. The lamps 28 are offset from the centrally positioned turntable 20 towards one side of the oven. This asymmetrical positioning of the lamps promotes uniform illumination of the food's surface (or the dark color turntable) during rotation of the turntable 20.

Figure 3:
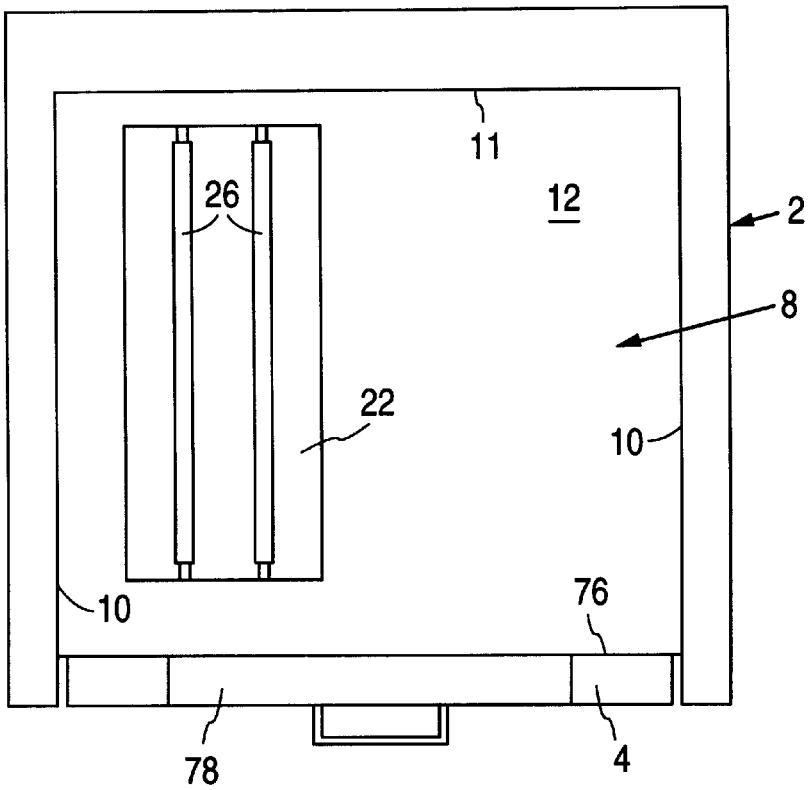
FIG. 3 is a cross-sectional top view of the lightwave oven of FIG. 1, showing the upper interior surface of the oven.

FIG. 3 shows the oven top wall 12. An upper reflector/lamp assembly 22 is mounted within the top wall 12, off to one side. A pair of 2300 W lamps 26 are mounted within the assembly 22 and extend towards the door 4 and back wall 11. These lamps have an overall length of approximately 13 inches. As with the lower lamps 28, upper lamps 26 are asymmetrically disposed within the oven to promote uniform illumination of the food surface during rotation of the turntable 20.

Upper and lower lamps 26, 28 are generally any of the quartz body, tungsten-halogen or high intensity discharge lamps that are commercially available. The lamps utilized in the lightwave oven described herein cook with approximately fifty percent (50%) of the energy in the visible and near-visible light portion of the spectrum when operated at full lamp power.

Behind each lamp is a reflector 25 (shown behind upper lamps 26 in FIG. 4) configured to optimize reflection of radiant energy into the oven cavity and, in particular, onto the surface of the food or the dark turntable when used. The reflectors may be configured to have one of many different types of geometries that will achieve this objective. For example, they may be parabolic or formed from a plurality of facets facing the interior of the oven.

Each lamp is mounted between a pair of electrodes (not shown). Power supply 7 is connected to the electrodes to operate, under the control of controller 9, each of the lamps 26, 28 simultaneously and/or individually.

Figure 4:
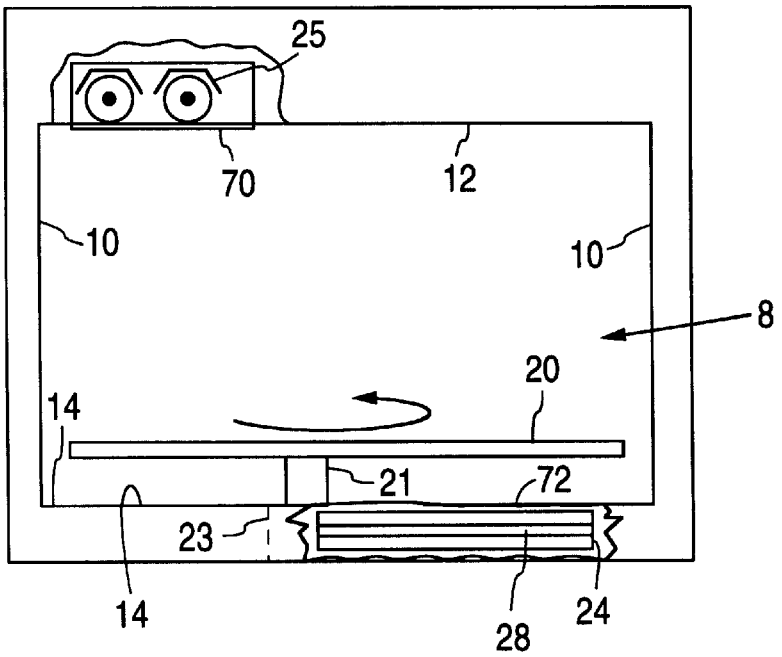
FIG. 4 is a cross-sectional front view of the lightwave oven of FIG. 1, taken along the plane designated 4—4 in FIG. 2.
Figure 5:
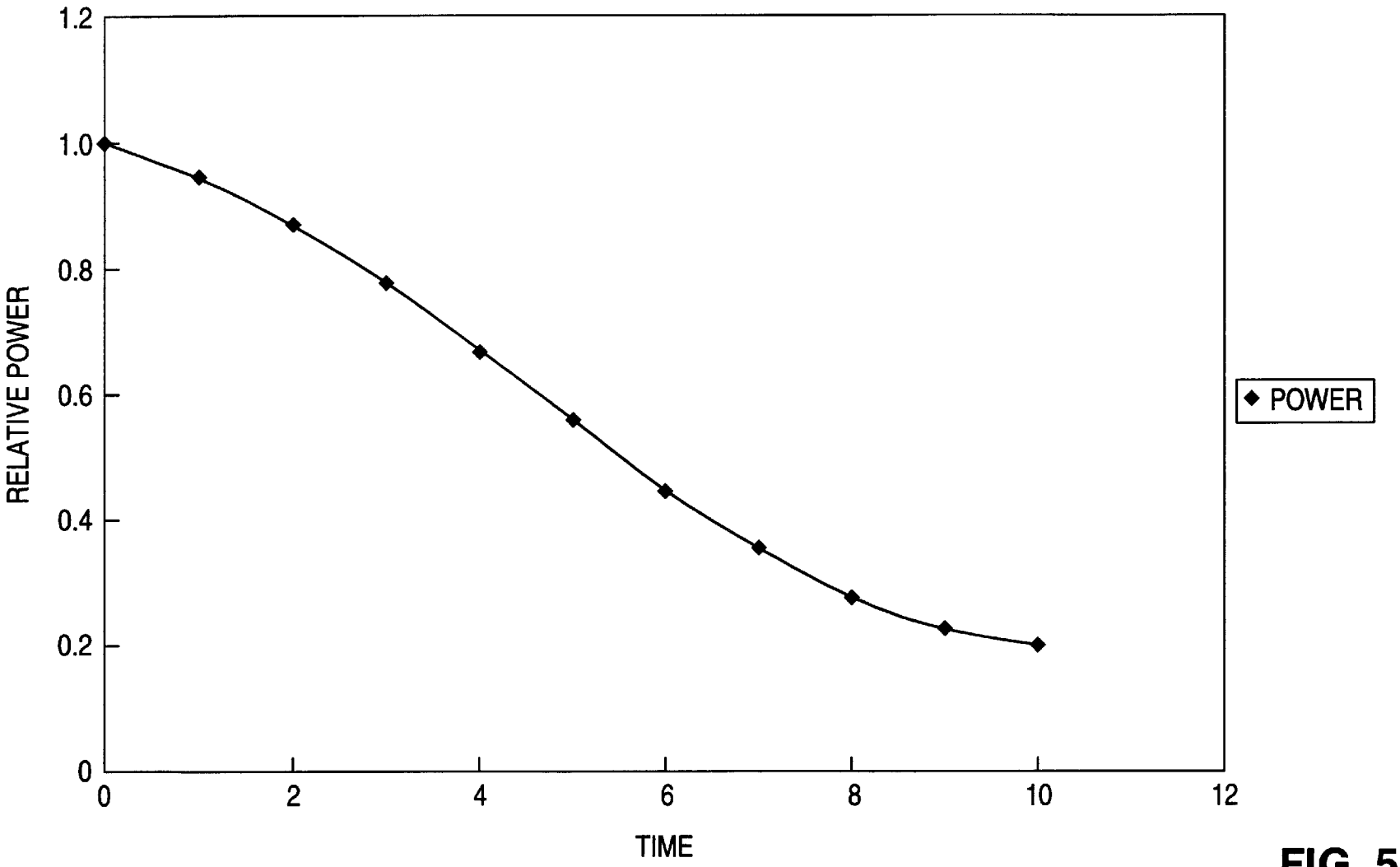
FIG. 5 is a graph showing lightwave cooking power ramps for the autopulse cooking mode.

Referring to FIG. 4, to keep foods from splattering cooking juices onto the lamps and reflectors, transparent upper and lower shields 70 and 72 cover the upper/lower lamp/reflector assemblies 22/24 respectively. Shields 70/72 are plates made of a glass or a glass-ceramic material that has a very small thermal expansion coefficient. Glass-ceramic materials available under the trademarks Pyroceram, Neoceram and Robax, and the borosilicate available under the name Pyrex, have been successfully used. These lamp shields isolate the lamps and reflecting surfaces so that drips, food splatters and food spills do not affect operation of the oven, and they are easily cleaned since each shield 70/72 consists of a single, plate of glass or glass-ceramic material.

It has been found that modest increases in the reflectivity of the oven walls leads to substantial increases in oven efficiency. In the lightwave oven described herein, the walls 10, 11, 12, 14, door inner surface 76 and reflectors 25 may be formed of polished, high-purity aluminum (such as the German brand Alanod having a reflectivity of about 90% (averaged in the wavelength range of interest from a 3000° K quartz tungsten-halogen lamp) and good heat resistance properties.

Other highly reflective materials may also be used. For example, the oven walls may be formed of a highly reflective porcelain material which has a reflectivity of about 87% over the range of interest. Alternatively, a highly reflective material made from a thin layer of high reflecting silver sandwiched between two plastic layers and bonded to a metal sheet, having a total reflectivity of about 95%. Such a highly-reflective material is available from Alcoa under the tradename EverBrite 95, or from Material Science Corporation under the tradename Specular+ SR. While the reflectivity is the way the metal surfaces are specified, a more important parameter is the absorption (which equals 100%—reflectivity), since this relates directly to the loss of radiation that strikes the walls. By increasing the reflectivity by about 5% over highly polished aluminum, the wall absorption has dropped from 10% to 5%, which is a factor of two. This means that there can be about double the number of reflections with the same total energy losses, so that there is a much greater probability of the food intercepting a multi-bounced light ray.

A window 78 is formed in the door 4 for viewing foods while they cook. The window 78 may be formed by bonding two plastic layers surrounding a reflecting silver layer to a transparent substrate such as plastic or glass (preferably tempered). It has been discovered that the amount of light that leaks through the reflective material used to form the interior of the oven is ideal for safely and comfortably monitoring the interior of the oven cavity while food cooks. Alternately, one could make the window 78 of two borosilicate (Pyrex) glass plates (about 3 mm thick), with the inner surfaces facing each other each being coated with a thin aluminum film having an approximate 600 angstrom thickness. The window 78 ideally should transmit about 0.1% of the incident light from the cavity 8, so that the user can safely view the food while it cooks.

Water vapor management, water condensation and airflow control in the cavity 8 can significantly affect the cooking of the food inside the oven. It has been found that the cooking properties of the oven (i.e., the rate of heat rise in the food and the rate of browning during cooking) is strongly influenced by the water vapor in the air, the condensed water on the cavity sides, and the flow of hot air in the cylindrical chamber. Increased water vapor has been shown to retard the browning process and to negatively affect the oven efficiency. Therefore, the oven cavity 8 need not be sealed completely, to let moisture escape from cavity 8 by natural convection. Moisture removal from cavity 8 can be enhanced through forced convention. A fan 80 (FIG. 2), which can be controlled as part of the cooking formula, provides a source of fresh air that is delivered to the cavity 8 to optimize the cooking performance of the oven.

Fan 80 also provides fresh cool air that is used to cool the high reflectance internal surfaces of the oven cavity 8. The cooling air flows into the oven through intake vents 82 on the front of the oven (FIG. 1), and out of the oven via exhaust port 92 (FIG. 2) located at the rear of the oven housing. The airflow from fan 80 can further be used to cool the oven power supply 7 and controller 9.

The oven 100 will be primarily used to cook food in lightwave mode, which uses fast lightwave cooking technology. One lightwave mode of cooking using the above-described oven is called the autopulse mode and is one which allows a large variety of food types to be cooked using a common mode of operation.

During use of the autopulse mode, all upper and lower lamps may be pulsed on and off simultaneously, making it a particularly suitable mode for higher power, 240V, lightwave ovens such as the one described herein. The duty cycle of the lamps is varied according to a predetermined function of time to decrease the percentage of time that the lamps 26, 28 are on.

During use of the autopulse mode, the user selects beginning and ending power settings for the oven. For example, the user may enter a starting power of 75% (corresponding to 75% "on" time for the lamps at full power) and an ending power of 25% (i.e., 25% "on" time at full power). Once the cooking cycle is initiated, the oven controller ramps the duty cycle according to an embedded algorithm, which varies depending upon the design of the lightwave oven. For example, for the oven 100, the ramp may follow the modified cosine function shown in FIG. 5. In other ovens such as the high efficiency lightwave oven mentioned above, the power ramp may be approximately linear. In all cases, when the lamps are "on" they are on at full power in order to utilize the maximum color temperature afforded by the lamps. A decrease in power to the food is achieved by decreasing the duty cycle of the lamps. Ramping down the power in this way allows higher power to be applied to the food at a time when both the food and the oven are cold and can accept energy at higher rates. The power is decreased as the food heats up and the surface of the food dries out and thus cannot accept energy at high rates without burning the surface of the food.

Figure 6A:
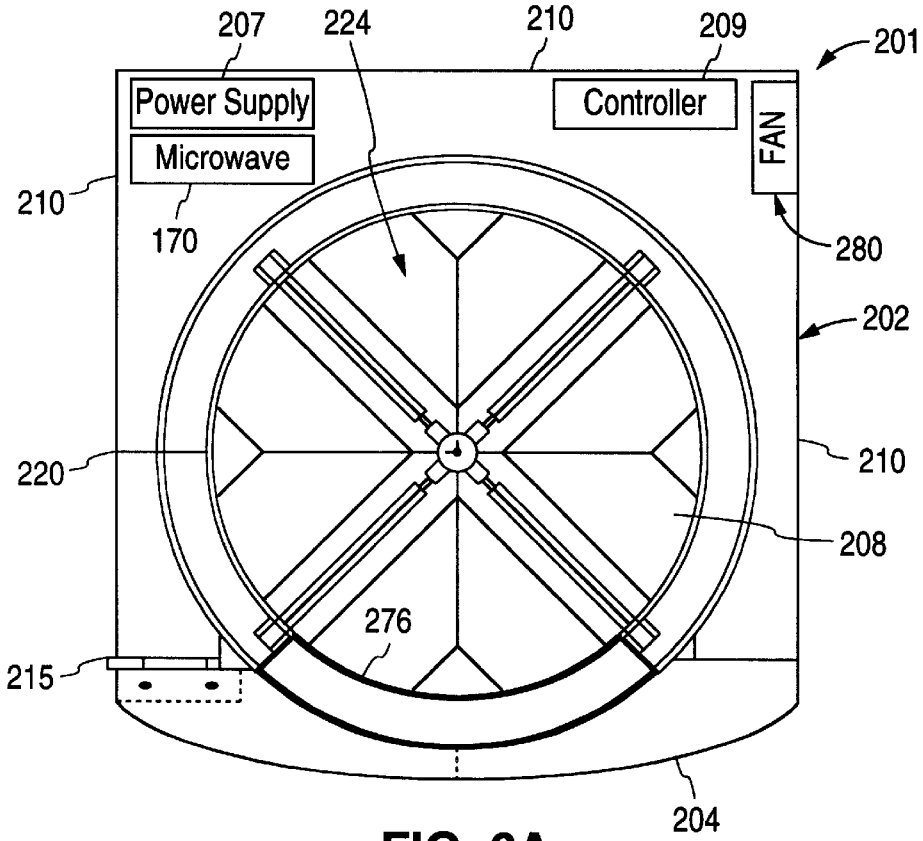
FIG. 6A is a top cross-sectional view of a lightwave oven.
Figure 6B:
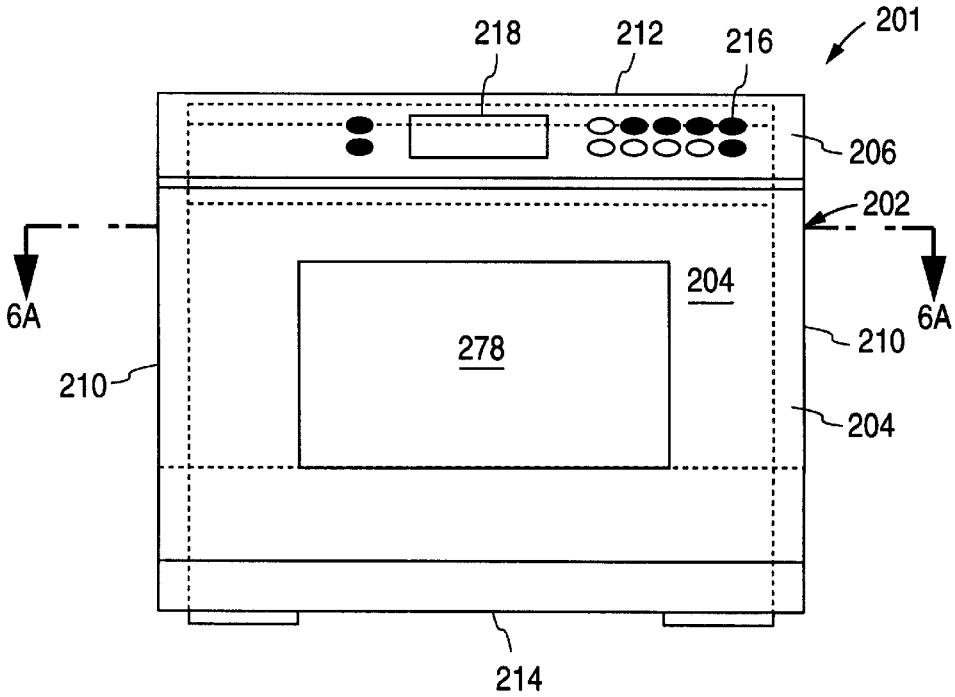
FIG. 6B is a front view of the lightwave oven of FIG. 6A.
Figure 6C:
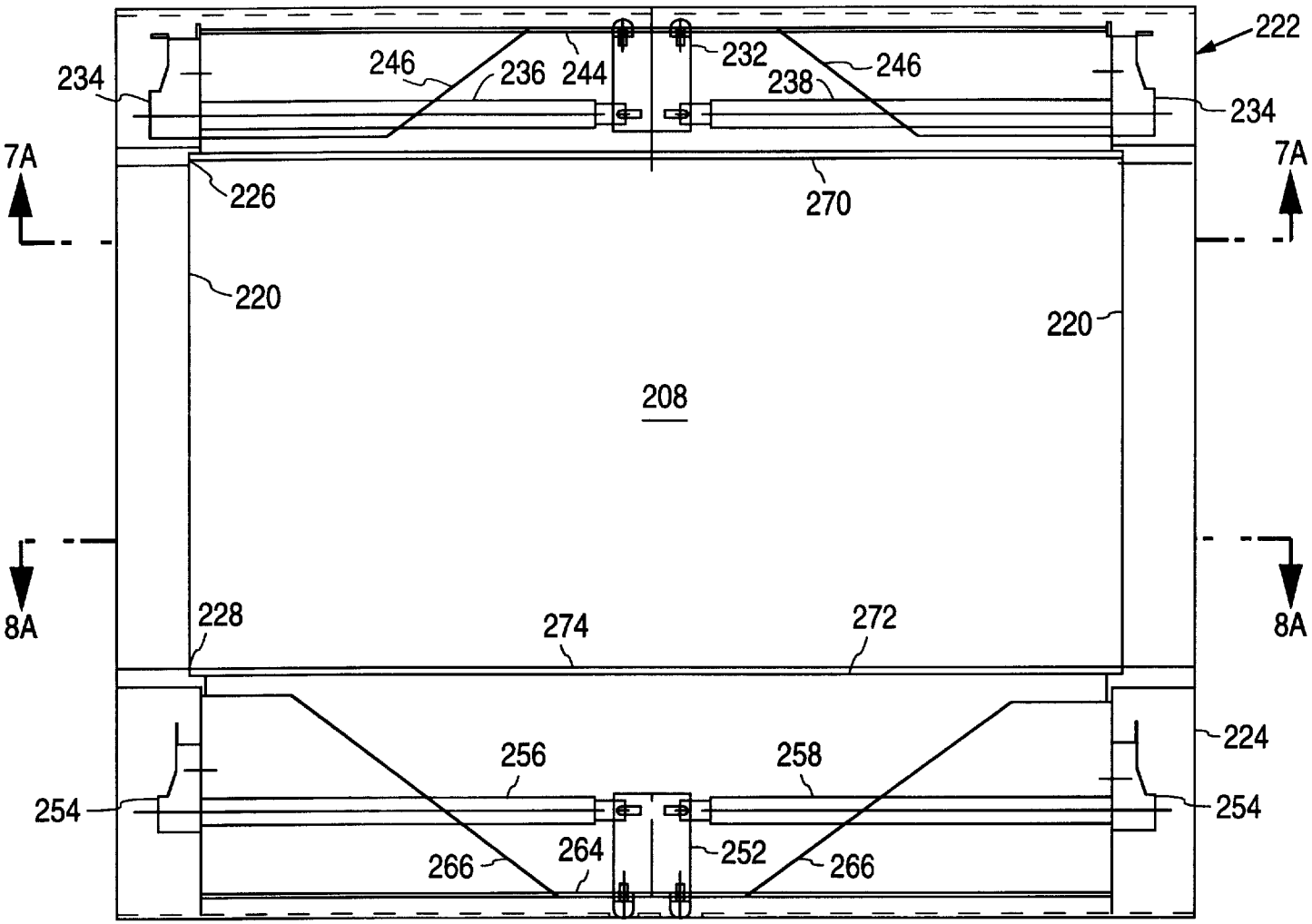
FIG. 6C is a side cross-sectional view of the lightwave oven of FIG. 6A.

A second, high efficiency cylindrically shaped oven 201 is illustrated in FIGS. 6A–6C. Oven 201 is ideal for connection to a standard 120 VAC kitchen outlet, which can cook using different modes of lamp operation to effect cooking, crisping, grilling, defrosting, warming and baking of foodstuffs. A brief description of the oven 201 will follow. More extensive details may be found in PCT/US98/18472, entitled LIGHTWAVE OVEN AND METHOD OF COOKING THEREWITH HAVING MULTIPLE COOK MODES AND SEQUENTIAL LAMP OPERATION, International Filing Date Sep. 4, 1998, which is incorporated herein by reference for all purposes.

The lightwave oven 201 includes a housing 202, a door 204, a control panel 206, a power supply 207, an oven cavity 208, and a controller 209.

The housing 202 includes sidewalls 210, top wall 212, and bottom wall 214. The door 204 is rotatably attached to one of the sidewalls 210 by hinges 215. Control panel 206, located above the door 204 and connected to controller 209, contains several operation keys 216 for controlling the lightwave oven 201, and a display 218 indicating the oven's mode of operation.

The oven cavity 208 is defined by a cylindrical-shaped sidewall 220, an upper reflector assembly 222 at an upper end 226 of sidewall 220, and a lower reflector assembly 224 at the lower end 228 of sidewall 220.

Figure 7A:
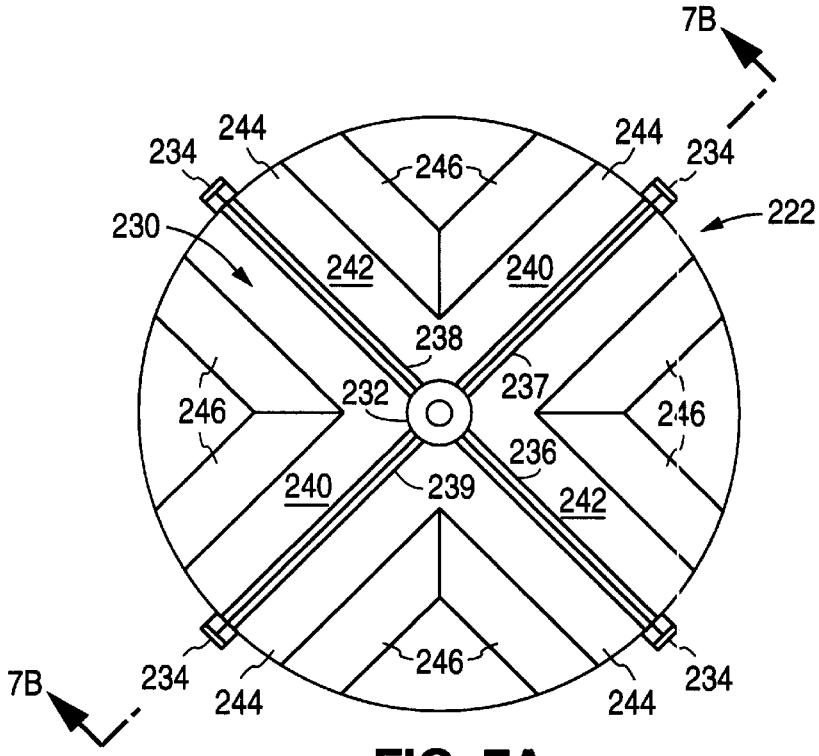
FIG. 7A is a bottom view of the upper reflector assembly of the oven of FIG. 6A.
Figure 7B:
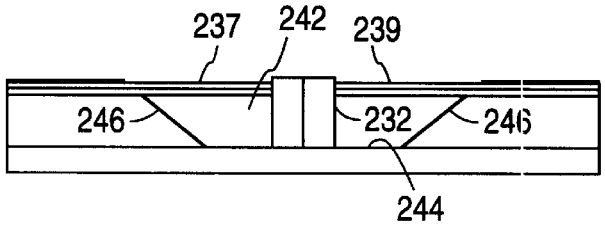
FIG. 7B is a side cross-sectional view of the upper reflector assembly.
Figure 7C:
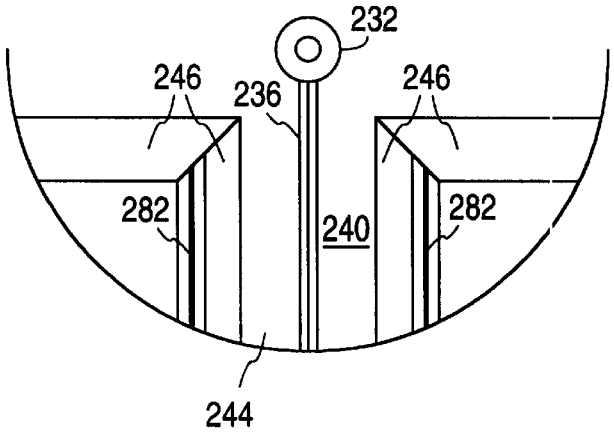
FIG. 7C is a partial bottom view of the upper reflector assembly illustrating the virtual images of one of the lamps.

Upper reflector assembly 222 is illustrated in FIGS. 7A–7C and includes a circular, non-planar reflecting surface 230 facing the oven cavity 208, a center electrode 232 disposed at the center of the reflecting surface 230, four outer electrodes 234 evenly disposed at the perimeter of the reflecting surface 230, and four upper lamps 236, 237, 238, 239 each radially extending from the center electrode to one of the outer electrodes 234 and positioned at 90 degrees to the two adjacent lamps. The reflecting surface 230 includes a pair of linear channels 240 and 242 that cross each other at the center of the reflecting surface 230 at an angle of 90 degrees to each other. The lamps 236–239 are disposed inside of or directly over channels 240/242. The channels 240/242 each have a bottom reflecting wall 244 and a pair of opposing planar reflecting sidewalls 246 extending parallel to axis of the corresponding lamp 236–239. (Note that for bottom reflecting wall 244, "bottom" relates to its relative position with respect to channels 240/242 in their abstract, even though when installed wall 244 is above sidewalls 246.) Opposing sidewalls 246 of each channel 240/242 slope away from each other as they extend away from the bottom wall 244, forming an approximate angle of 45 degrees to the plane of the upper cylinder end 226.

Figure 8A:
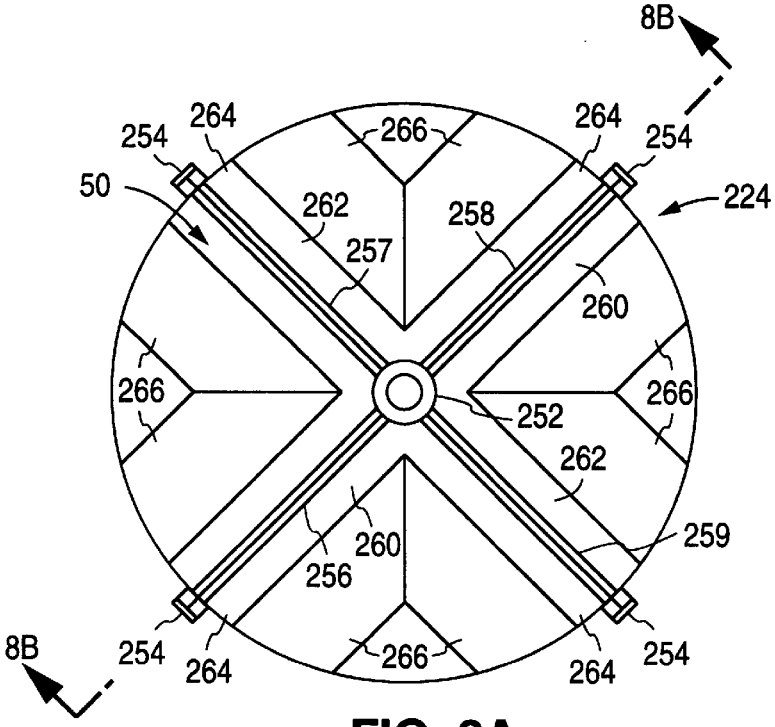
FIG. 8A is a top view of the lower reflector assembly of the oven of FIG. 6A.
Figure 8B:
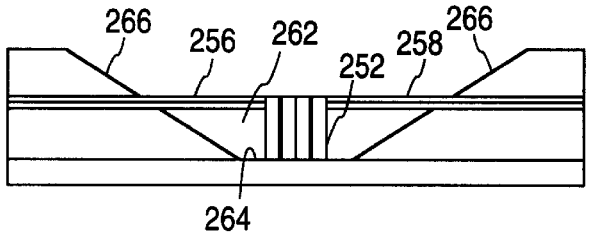
FIG. 8B is a side cross-sectional view of the lower reflector assembly.
Figure 8C:
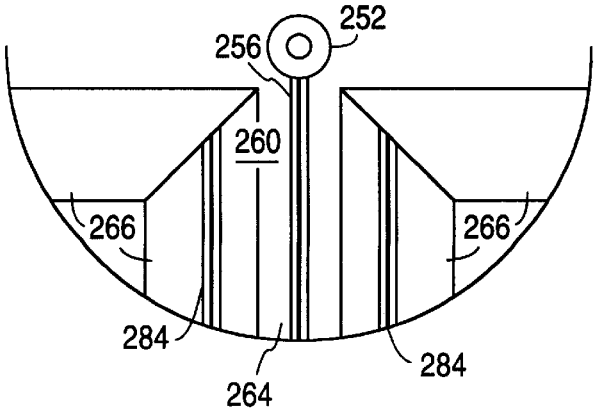
FIG. 8C is a partial top view of the lower reflector assembly illustrating the virtual images of one of the lamps.

Lower reflector assembly 224 illustrated in FIGS. 8A–8C has a similar construction as upper reflector 222, with a circular, non-planar reflecting surface 250 facing the oven cavity 208, a center electrode 252 disposed at the center the reflecting surface 250, four outer electrodes 254 evenly disposed at the perimeter of the reflecting surface 250, and four lower lamps 256, 257, 258, 259 each radially extending from the center electrode to one of the outer electrodes 254 and positioned at 90 degrees to the two adjacent lamps. The reflecting surface 250 includes a pair of linear channels 260 and 262 that cross each other at the center of the reflecting surface 250 at an angle of 90 degrees to each other. The lamps 256–259 are disposed inside of or directly over channels 260/262. The channels 260/262 each have a bottom reflecting wall 264 and a pair of opposing planar reflecting sidewalls 266 extending parallel to axis of the corresponding lamp 256–259. Opposing sidewalls 266 of each channel 260/262 slope away from each other as they extend away from the bottom wall 264, forming an approximate angle of 45 degrees to the plane of the lower cylinder end 228.

Power supply 207 is connected to electrodes 232, 234, 252 and 254 to operate, under the control of controller 209, each of the lamps 236–239 and 256–259 individually. Fan 280 provides fresh cool air that is used to cool the high reflectance internal surfaces of the oven cavity 208.

To keep foods from splattering cooking juices onto the lamps and reflecting surfaces 230/250, transparent upper and lower shields 270 and 272 are placed at the cylinder ends 226/228 covering the upper/lower reflector assemblies 222/224 respectively.

Upper and lower lamps 236–239 and 256–259 are generally any of the quartz body, tungsten-halogen or high intensity discharge lamps commercially available, e.g., 1 KW 120 VAC quartz-halogen lamps. The oven according to the preferred embodiment utilizes eight tungsten-halogen quartz lamps, which are about 7 to 7.5 inches long and cook with approximately fifty percent (50%) of the energy in the visible and near-visible light portion of the spectrum at full lamp power.

Door 204 has a cylindrically shaped interior surface 276 that, when the door is closed, maintains the cylindrical shape of the oven cavity 208. A window 278 is formed in the door 204 (and surface 276) for viewing foods while they cook. Window 278 is preferably curved to maintain the cylindrical shape of the oven cavity 208.

In the oven 1, the inner surface of cylinder sidewall 20, door inner surface 76 and reflective surfaces 30 and 50 are formed of a highly reflective material made from a thin layer of high reflecting silver sandwiched between two plastic layers and bonded to a metal sheet, having a total reflectivity of about 95%. Such a highly-reflective material is available from Alcoa under the tradename EverBrite 95, or from Material Science Corporation under the tradename Specular+ SR.

While all eight lamps could operate simultaneously at full power if adequate electrical power were available, the lightwave oven 201 has been specifically designed to operate as a counter-top oven that plugs into a standard 120 VAC outlet. A typical home kitchen outlet can only supply 15 amps of electrical current, which corresponds to about 1.8 KW of power. This amount of power is sufficient to only operate two commercially available 1 KW tungsten halogen lamps at color temperatures of about 2900° K. Operating additional lamps all at significantly lower color temperatures is not an option because the lower color temperatures do not produce sufficient amounts of visible and near-visible light. However, by sequential lamp operation as described below and illustrated in FIGS. 9A–9C, different selected lamps from above and below the food can be sequentially switched on and off at different times to provide a uniform time-averaged power density of about 0.7 $W/cm^2$ without having more than two lamps operating at any given time. This power density cooks food about twice as fast as a conventional oven.

For example, one lamp above and one lamp below the cooking region can be turned on for a period of time (e.g. 2 seconds). Then, they are turned off and two other lamps are turned on for 2 seconds, and so on. By sequentially operating the lamps in this manner, a cooking region far too large to be evenly illuminated by only two lamps is in fact evenly illuminated when averaged over time using eight lamps with no more than two activated at once. Further, some lamps may be skipped or have operation times reduced to provide different amounts of energy to different portions of the food surface.

Figure 9A:
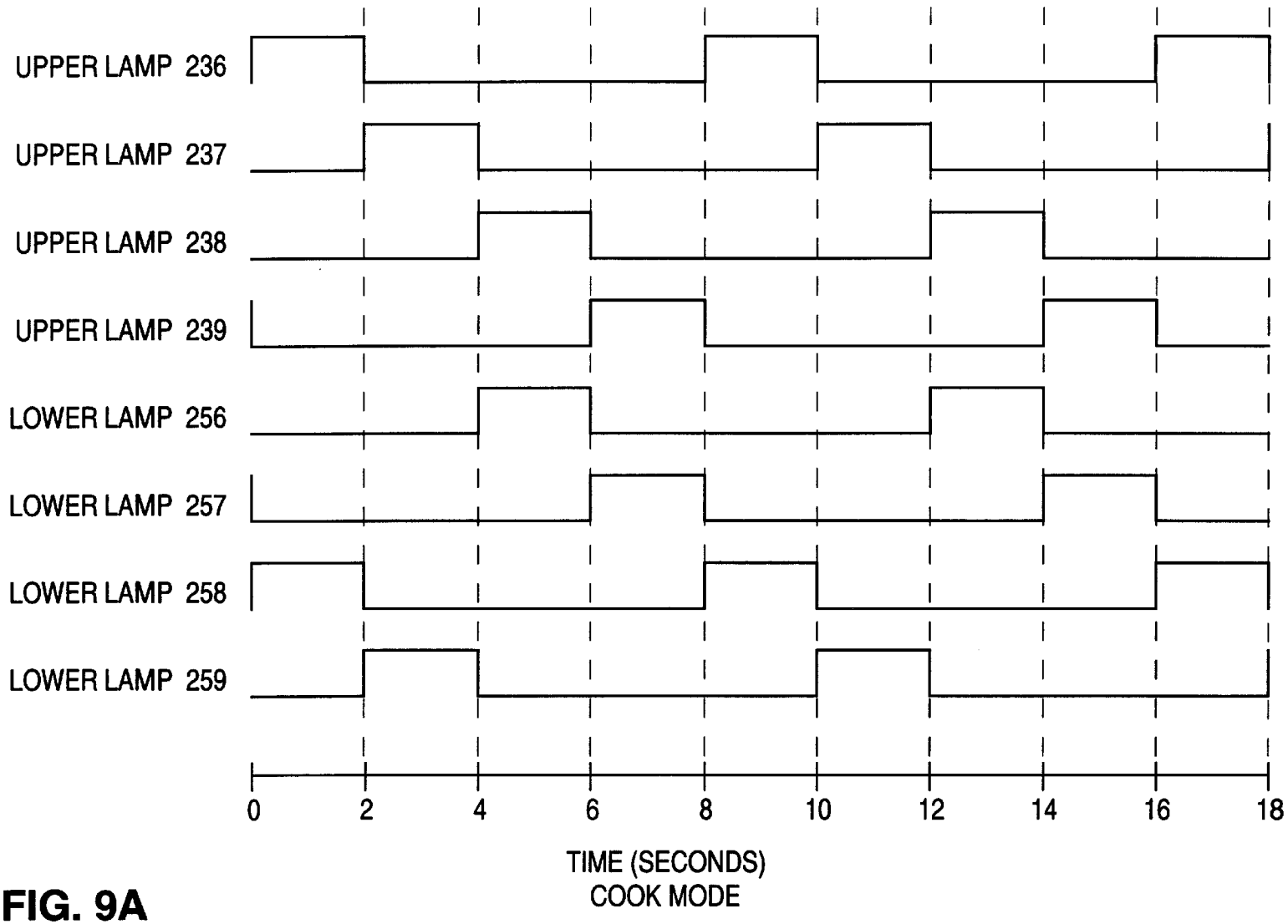
FIG. 9A is a graph showing the sequential lamp activation times for the cook mode of operation.

A first mode of sequential lamp operation (cook mode) for evenly cooking all sides of the food is illustrated in FIG. 9A. In cook mode, one upper lamp 236 and one lower lamp 258 are initially turned on, so that the total operating power does not exceed twice the operating power of each of the lamps. These lamps 236/258 are maintained on for a given period of time, such as two seconds, and then are turned off (for about 6 seconds). At the time lamps 236/258 are turned off, a different upper lamp 237 and a different lower lamp 259 are turned on. These lamps 237/259 are maintained on for two seconds and are then turned off at the same time the upper lamp 238 and lower lamp 256 are turned on, to be followed in sequence by upper lamp 239 and lower lamp 257. This cook mode sequential lamp operation continues repeatedly which provides time-averaged uniform cooking of the food in the oven chamber 208 without drawing more than the power needed to operate two lamps simultaneously. Preferably, the upper lamp in operation is on the opposite side of the reflector assembly 222 than the corresponding side of reflector assembly 24 containing the lower lamp in operation. Therefore, lamp operation above the food rotates among the four upper lamps 236–239 in the same direction around the cavity as the rotation of lamp operation below the food among the four lower lamps 256–259.

Figure 9B:
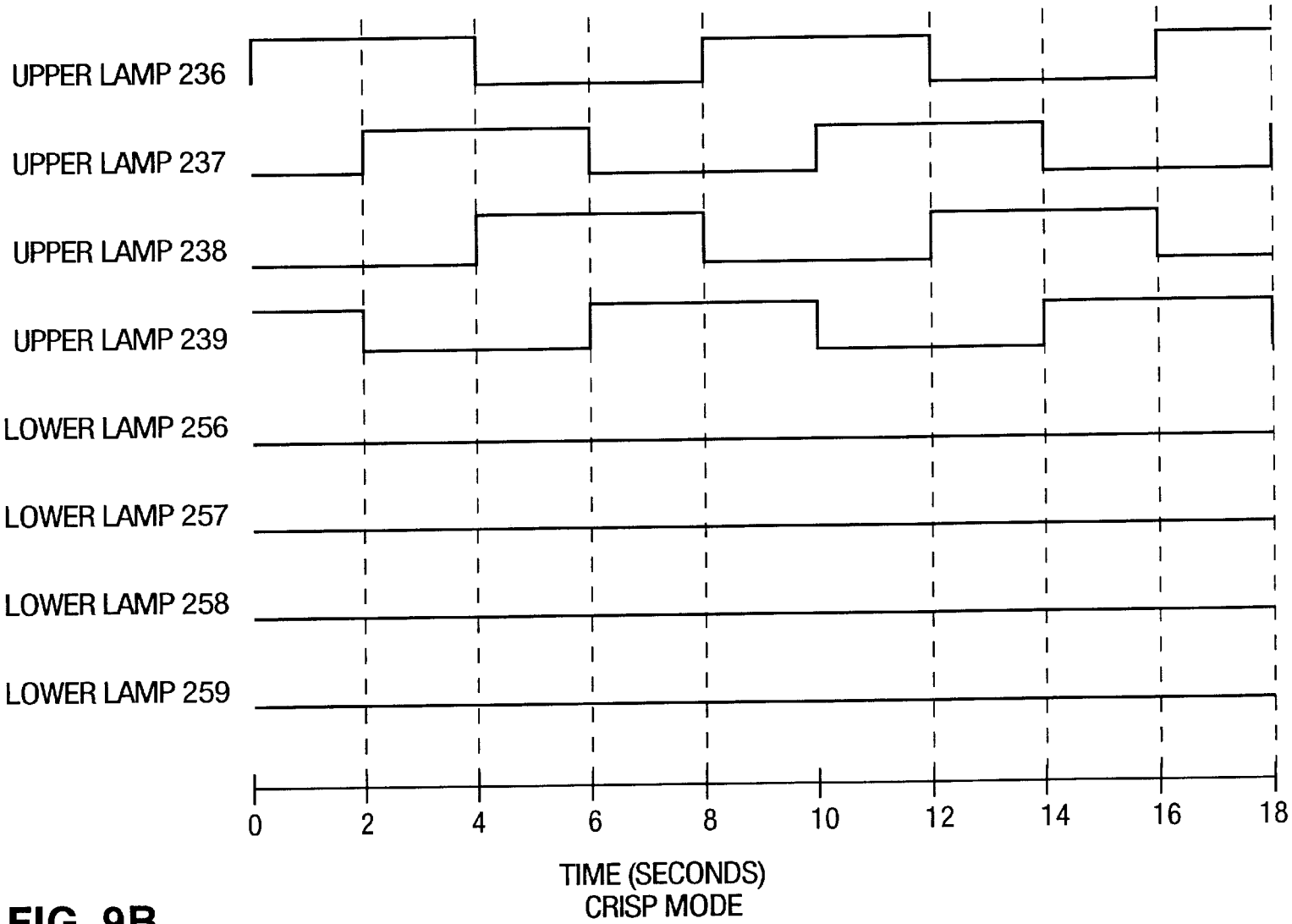
FIG. 9B is a graph showing the sequential lamp activation times for the crisp mode of operation.

A second mode of sequential lamp operation (crisp mode) for cooking and browning mainly the top side of the food is illustrated in FIG. 9B. In crisp mode, each upper lamp 236–239 is turned on for four seconds, then turned off for four seconds, with the operation of these lamps staggered so that only two lamps are on at any given time. Lower lamps 256–259 are not activated. For example, two upper lamps 236/239 are initially turned on, so that the total operating power does not exceed twice the operating power of each of the lamps. These upper lamps 236/239 are maintained on for a given period of time, such as two seconds, and then one of the lamps 239 is turned off, and another upper lamp 237 is turned on. Two seconds later, upper lamp 236 is turned off, and upper lamp 238 is turned on. Two seconds later, upper lamp 237 is turned off and upper lamp 239 is turned on. This crisp mode sequential lamp operation continues repeatedly which provides time-averaged uniform irradiation of mainly the top surface of the food in the oven chamber 208 without drawing more than the power needed to operate two lamps simultaneously.

A cook mode formula has also been developed based upon the discovery that for many foods, such as meats and pizza, the final cooked foodstuff quality is improved if a cooking sequence using cook mode is concluded in the crisp mode. The added browning effect improves most foods cooked in cook mode, while other foods that do not need any extra browning are not adversely affected. The cook mode formula simply calls for the cooking mode to be switched from cook mode to crisp mode for the last few minutes of the cooking sequence. The actual time $t_c$ that the cook mode is converted to the crisp mode varies depending on the overall cook time T of the cooking sequence, as illustrated below:

For T=under 10 minutes, $t_c$ should be 2 minutes.
For T=10–20 minutes, $t_c$ should be 4 minutes.
For T=20–30 minutes, $t_c$ should be 6 minutes.
For T=30–60 minutes, $t_c$ should be 8 minutes.
For T=greater than 60 minutes, $t_c$ should be 10 minutes.

Therefore, as an example, a foodstuff that normally cooks well in cook mode in 40 minutes, will cook better by being cooked in cook mode for 32 minutes followed by the crisp mode for 8 minutes. It should be noted that the cook mode formula also varies depending upon higher/lower maximum power densities, cavity size, overall oven cavity reflectivity, oven cavity wall materials, and the type and color temperature of the lamps used.

Figure 9C:
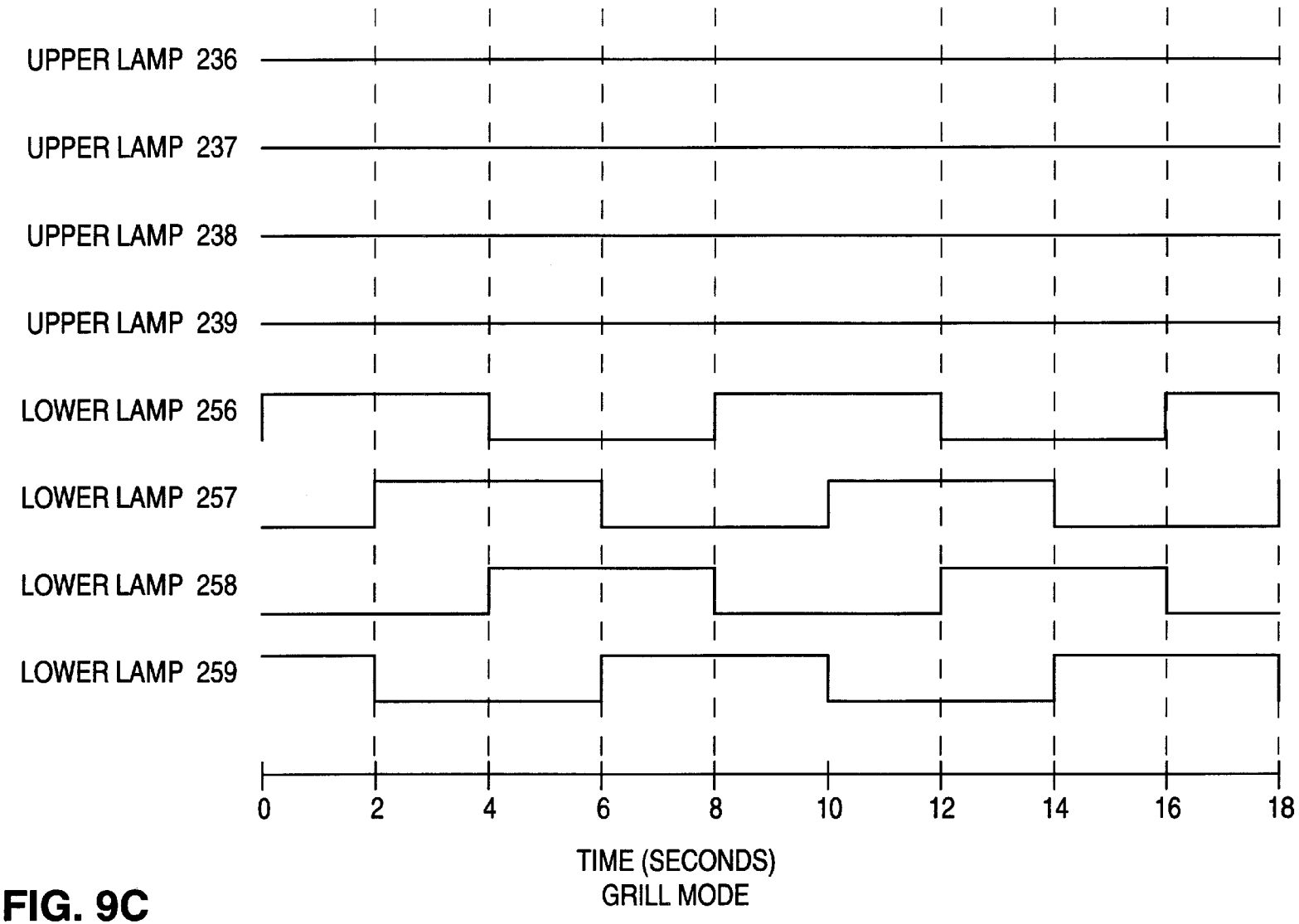
FIG. 9C is a graph showing the sequential lamp activation times for the grill mode of operation.

A third mode of sequential lamp operation (grill mode) for cooking and browning mainly the bottom side of the food such as pizzas and for searing and grilling meats is illustrated in FIG. 9C, and is identical to the crisp mode except just the bottom lamps 256–259 are operated instead of just the top lamps 236–239. In grill mode, each lower lamp 256–259 is turned on for four seconds, then turned off for four seconds, with the operation of these lamps staggered so that only two lamps are on at any given time. For example, two lower lamps 256/259 are initially turned on, so that the total operating power does not exceed twice the operating power of each of the lamps. These lower lamps 256/259 are maintained on for a given period of time, such as two seconds, and then one of the lamps 259 is turned off, and another lower lamp 257 is turned on. Two seconds later, lower lamp 256 is turned off, and lower lamp 258 is turned on. Two seconds later, lower lamp 257 is turned off and lower lamp 259 is turned on. This grill mode sequential lamp operation continues repeatedly which provides time-averaged uniform irradiation of mainly the bottom surface of the food in the oven chamber 208 without drawing more than the power needed to operate two lamps simultaneously.

Often this grill mode of operation is used in conjunction with a special broiler pan to improve the grilling of meats and fish. This pan has a series of formed linear ridges on its upper surface which supports and elevates the food. The valleys between the ridges serve to catch the grease from the grilling process so that the food is separated from its drippings for better browning. The entire pan heats up quickly from the bottom radiant energy in the grill mode, and this heat sears the surface of the food that is in contact with the ridges, leaving browned grill marks on the food surface. The surface of the pan is coated with a non-stick material to make cleaning easier. Visible and near-visible radiation from the bottom lamps can also bounce from the sidewall 220 and upper reflecting surface 230 to strike the food from the top and sides. This additional energy aids in the cooking of the top portion of the food.

A fourth mode of operation is the warming mode, where all lamps 236–239 and 256–259 are all operated simultaneously, not sequentially, at low power (e.g. 20% of full power) so that the total power of all eight operating lamps does not exceed the full power operation of two of the lamps (i.e. about 1.8 KW). With lamps operating at such a low power, and therefore a low color temperature, most of the radiation emitted by the lamps in warming mode is infrared radiation, which is ideal for keeping food warm (at a stable temperature) without further cooking it.

It should be noted that the operating times of 2 seconds in cook mode or 4 seconds in grill or crisp modes for each lamp described above are illustrative, and can be lower or higher as desired. However, if the lamp operating time is set too low, efficiency will be lost because the finite time needed to bring the lamps up to operating color temperature causes the average lamp output spectrum to shift undesirably toward the red end of the spectrum. If the lamp operating time is too long, uneven cooking will result. It has been determined that a lamp operating time of up to at least 15 seconds provides excellent efficiency without causing significant uneven cooking.

In the cook mode described above, an average cooking power density of about 0.7 $W/cm^2$ is generated in the oven cavity 208 by two lamps operating at full power (100% oven intensity). However, it is anticipated that some cooking recipes will require the oven intensity to be reduced below 100% for some or all of the cooking time. Reducing power to the lamps reduces the color temperature of the lamps, and thus the percentage of the visible and near-visible light emitted by the lamps. Therefore, instead of individual lamp power reduction that affects the lamp output spectrum, the oven 201 includes the feature of reducing the overall oven duty cycle (reducing the average power level from one or both lamp sets) without adversely affecting the spectral output of the lamps.

Figure 10:
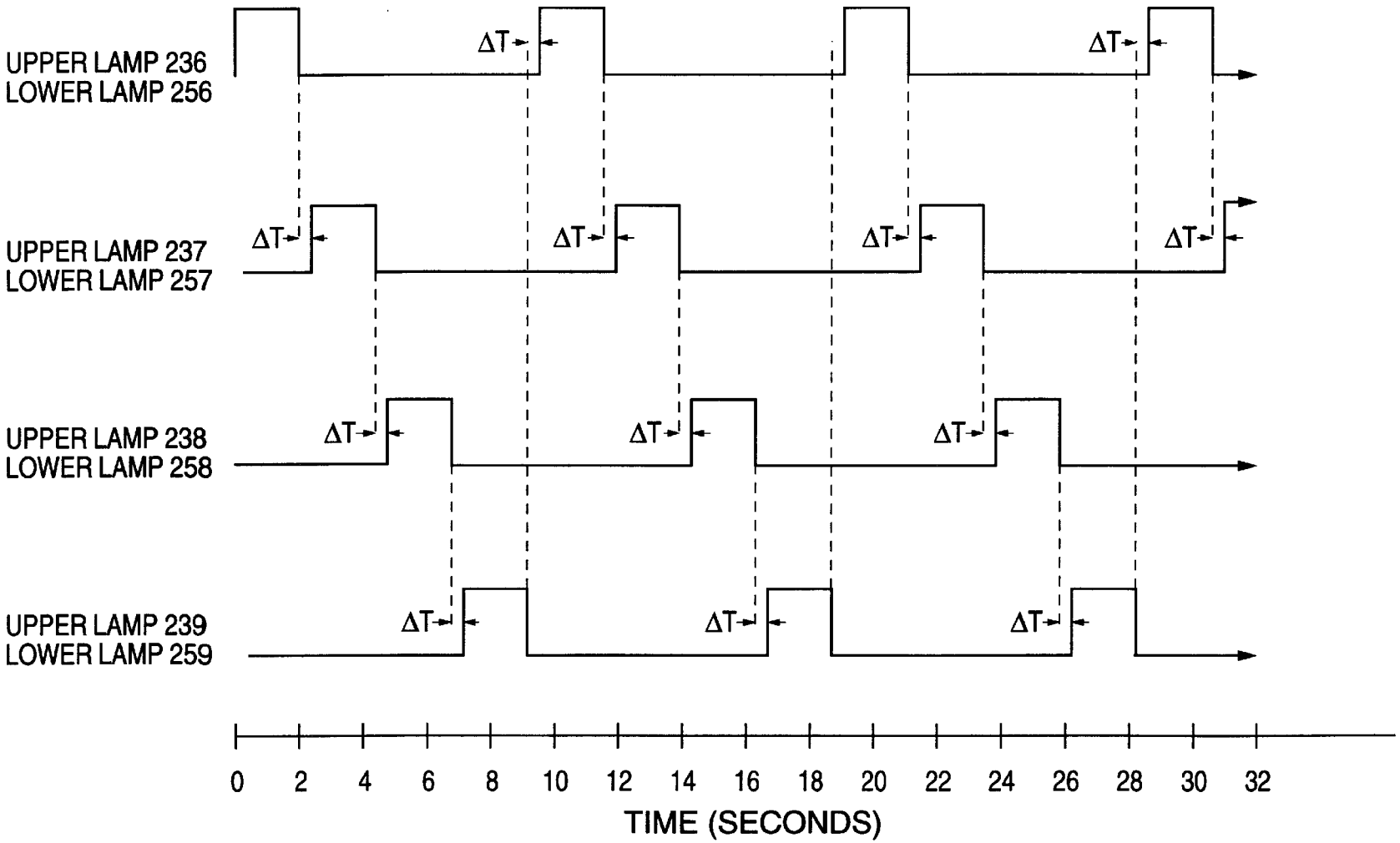
FIG. 10 is a graph showing the sequential lamp activation times for the cook mode of operation with a reduced oven intensity.
Figure 11A:
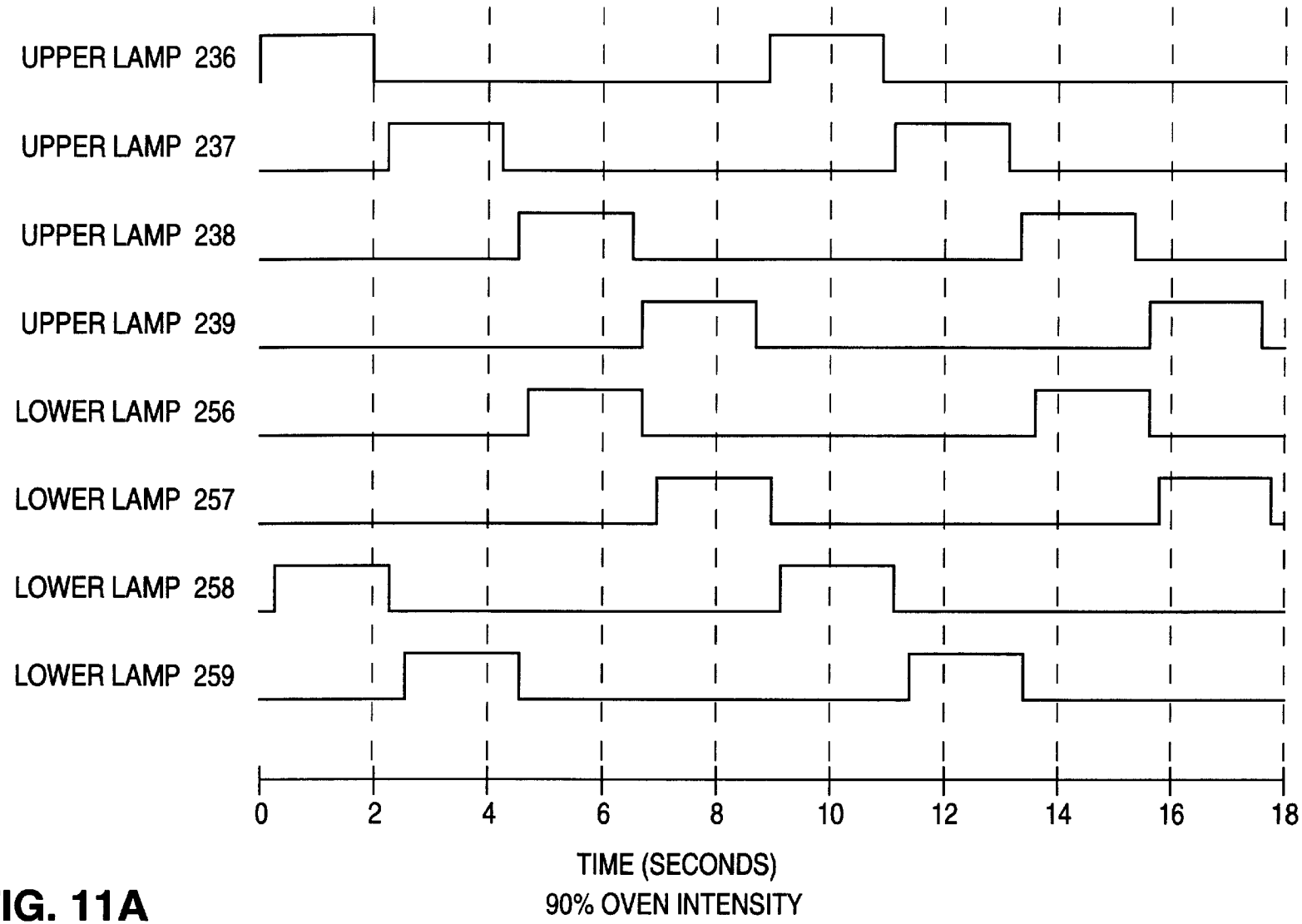
FIG. 11A is a graph showing the sequential lamp activation times for the cook mode of operation with a reduced oven intensity of 90%.
Figure 11B:
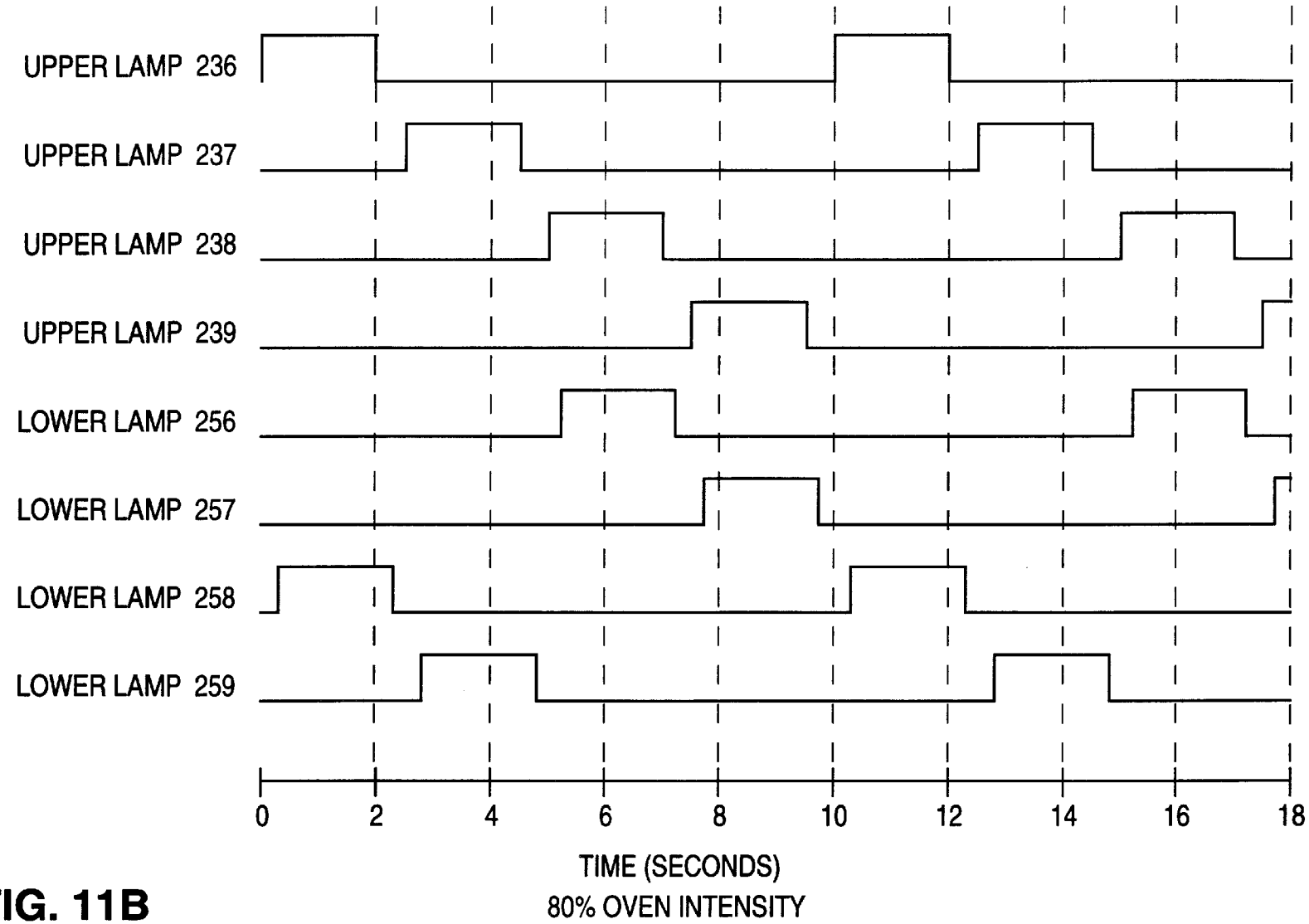
FIG. 11B is a graph showing the sequential lamp activation times for the cook mode of operation with a reduced oven intensity of 80%.
Figure 11C:
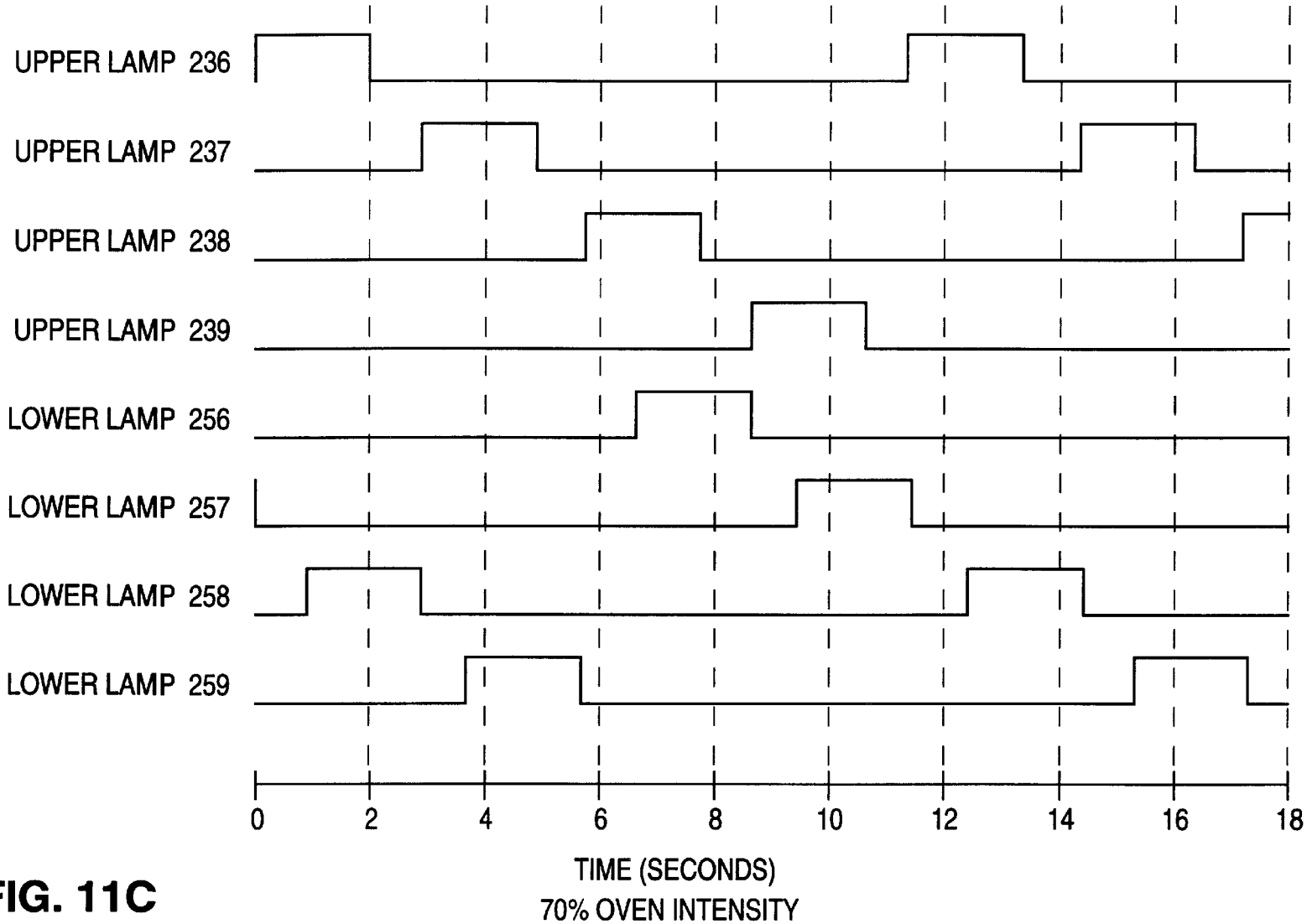
FIG. 11C is a graph showing the sequential lamp activation times for the cook mode of operation with a reduced oven intensity of 70%.
Figure 11D:
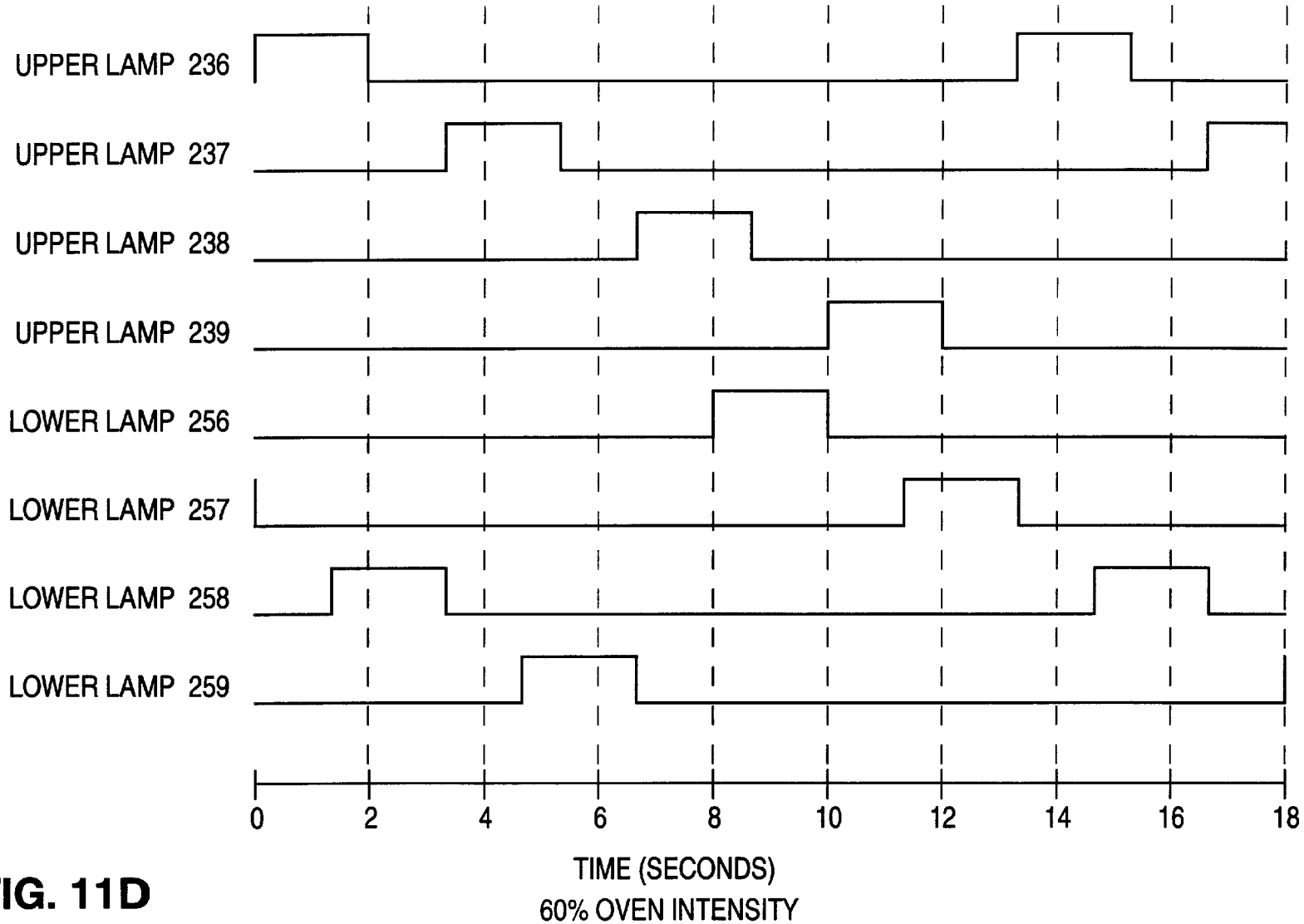
FIG. 11D is a graph showing the sequential lamp activation times for the cook mode of operation with a reduced oven intensity of 60%.
Figure 11E:
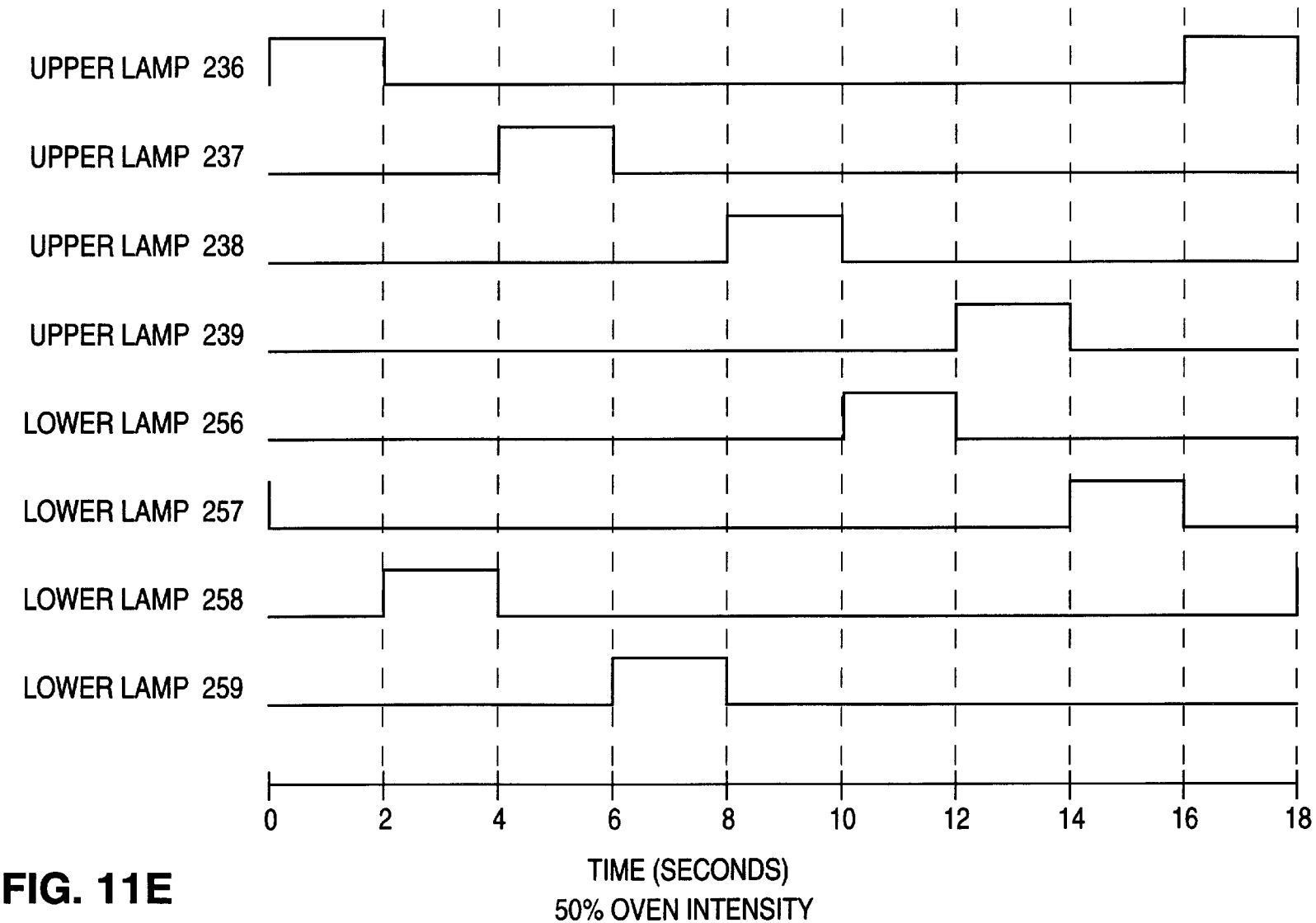
FIG. 11E is a graph showing the sequential lamp activation times for the cook mode of operation with a reduced oven intensity of 50%.

The duty cycle reduction feature for reducing the (time) average power level of the upper lamps and the lower lamps is illustrated in FIG. 10 in the cook mode, however this feature is usable with any set of lamps in any mode of oven operation. The feature reduces the oven intensity by adding a time delay ΔT between the shut down of one lamp and the turn on of the next consecutive lamp so that the lamps still operate at full power but operate with a reduced overall duty cycle. For example, the first upper/lower lamps 236/256 are turned on for 2 seconds and then off, and a time delay period ΔT, such as 0.2 seconds, passes before the second upper/lower lamps 37/57 are turned on for two seconds and then off, and another 0.2 seconds pass before the third upper/lower lamps 238/258 are turned on, and so on with the fourth upper/lower lamps 239/259, for one or more cycles. In the above example, with the lamps operated for 2 seconds, separated by a time delay ΔT of 0.2 seconds, the overall time-average oven intensity (duty cycle) is about 91% of the full oven power intensity (duty cycle).

It is advantageous to have at least one of the lamps in the oven on at all times so the user can continuously view the cooking food. Therefore, the on/off cycles of the upper set of lamps 236–239 and lower set of lamps 256–259 can be staggered so that at least one lamp is on at all times for overall duty cycles as low as 50%. FIGS. 11A–11E illustrate 90%, 80%, 70%, 60% and 50% time-average oven intensity (reduced duty cycle) operation in cook mode respectively, which correspond to ΔT values of 0.22, 0.50, 0.86, 1.33 and 2.0 minutes, respectively. The upper lamp cycle is shown staggered to the lower lamp cycle so that the cavity is continuously illuminated. The time delay ΔT can be different for the upper lamps 236–239 relative to the lower lamps 256–259. Thus, upper lamps 236–239 can operate at one time-average intensity (e.g. 80%) while lower lamps 256–259 can operate at a different time-average intensity (e.g. 60%). Thus, each lamp is operated at fully power, but by reducing the duty cycle as described above, the average power level of each lamp set can be reduced without adversely affecting the lamp spectrum.

A fifth mode of lamp operation is the defrost mode, which heats food without cooking. The defrost mode is the cook mode with a highly reduced oven intensity (duty cycle). For the present described oven, operating the oven at about 30% of full oven intensity (30% duty cycle) defrosts most foods with little or no cooking effect. Intermittent full lamp power is necessary to penetrate the food interior with visible light. However, full lamp power for an extended period of time will start cooking portions of the food.

Figure 12:
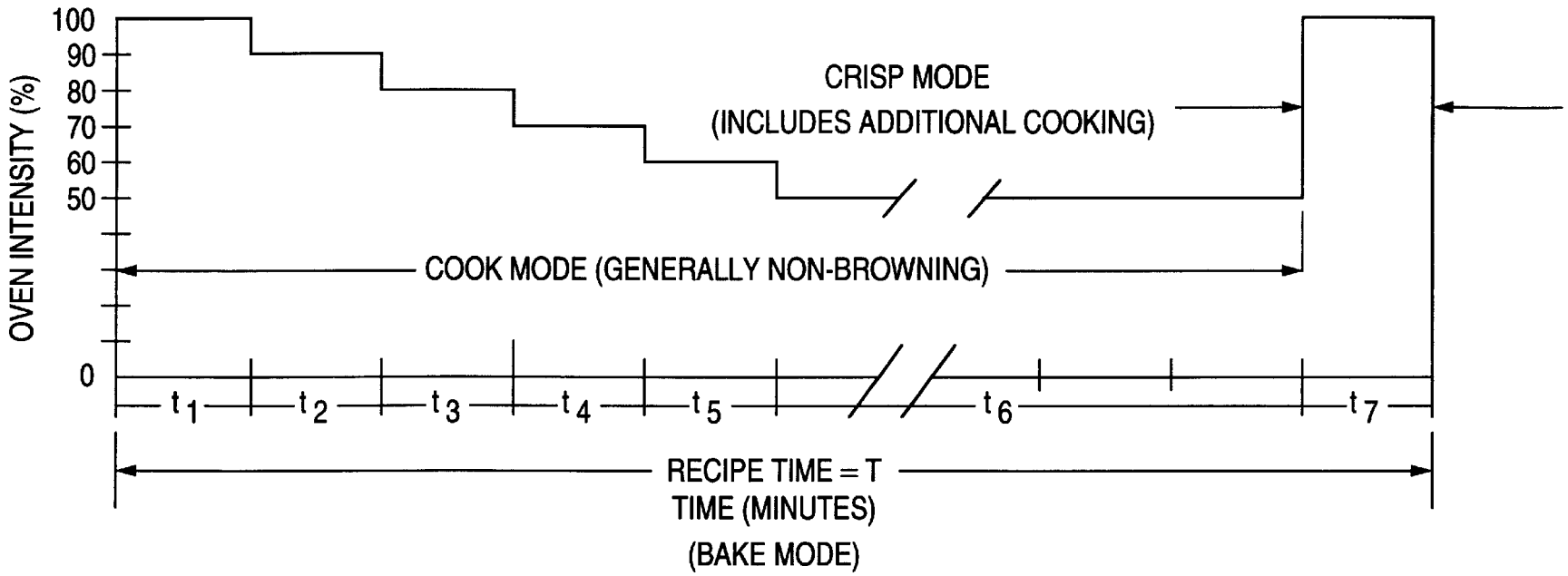
FIG. 12 is a graph showing the sequential lamp activation times for the bake mode of operation.

A sixth mode of lamp operation is the bake mode, illustrated in FIG. 12. Baking of foods that have to rise as well as brown (e.g. pies, breads, cookies, cakes) requires that the food interior sufficiently cooks (reaches a certain peak temperature) and the food surface sufficiently browns. The method of baking in a conventional oven includes selecting an oven temperature and a bake time so that the food interior peak temperature and the ideal surface browning are achieved simultaneously at the end of the bake time. Thus, the cooking of the food interior and the browning of the food surface occur simultaneously. This baking process cannot be sped up by simply increasing the oven temperature because that would cause the browning to occur too soon, before the food interior is fully cooked.

Likewise, in the lightwave oven 201, many foods have to be baked in cook mode using less than the full time-average oven intensity so that the food interior cooking and the food surface browning are completed at about the same time. If the oven power is too high, then water is prematurely driven off of the food surface, and the food surface browns and burns before the food interior can be fully cooked.

The present inventors have developed the bake mode illustrated in FIG. 12 to solve the above mentioned problems. In bake mode, the lightwave oven combines varying cooking intensities in the cook mode with high intensity browning in the crisp mode to bake food. Bake mode essentially cooks the interior of the food first, and browns the food surface mostly at the end of the baking cycle. In bake mode, the oven initially operates at 100% oven intensity for a predetermined time period $t_1$. During this initial time period, very little surface browning occurs because the food starts out cold with plenty of food surface moisture. As the food bakes, lower oven intensities are required to prevent food surface browning (which would prevent visible and near-visible light penetration needed to cook the food's interior). Therefore, after time period $t_1$ expires, the time-average oven intensity is reduced to 90%, for a time period $t_2$, and then to 80% oven intensity for time period $t_3$, and then to 70% oven intensity for time period $t_4$, and then to 60% oven intensity for time period $t_5$, and then to 50% oven intensity for time period $t_6$. The food interior continues to cook at the reduced oven intensities without significant food surface browning. Once the food interior has nearly reached its peak temperature (fully cooked), high oven intensity (100%) is used for a time period $t_7$ to brown the food's surface (and finish the interior cooking of the food). Ideally, the cook mode (upper and lower lamps) is used during time intervals $t_1$ to $t_6$ for even cooking of the food's interior, and crisp mode (upper lamps only) is used during time interval $t_7$ to brown the food's surface from above. This bake mode operation of the present lightwave oven produces high quality baked goods in much less time than a conventional oven.

Compensation For Line Voltage Fluctuation

Line voltage into a home or business can vary as much as +5% to −10% throughout the course of a day. Variations in lightwave cooking performance can occur with various in line voltage. It has been found that the power out of a tungsten halogen lamp varies as the applied voltage is raised to the 1.57 power. In the lightwave ovens, variations of +5% to −10% can therefore correspond to power variations of +8% and −16%, respectively, about the normal performance when the oven voltage is at its nominal value (i.e., 120V for oven 201, or 240 V for oven 100). Such variations can make a significant difference in the cooking performance of the oven and particularly in the browning levels of baked or roasted foods, especially when they are as high as 10% or more.

For this reason, a system has been developed for monitoring for changes in line voltage and for modifying the oven power to compensate for such changes. The system includes a circuit for measuring changes in line voltage by measuring the current through the lamps or the voltage across the lamps, together with an algorithm for increasing or decreasing the lamp "on" time in order to compensate for power changes which occur as a result of the line voltage variations. The compensation algorithm preferably compensates for line voltage variations of approximately +5% to −10% which, for a 240V oven, corresponds to a line voltage range of approximately 216 V to 252 V.

Figure 13:
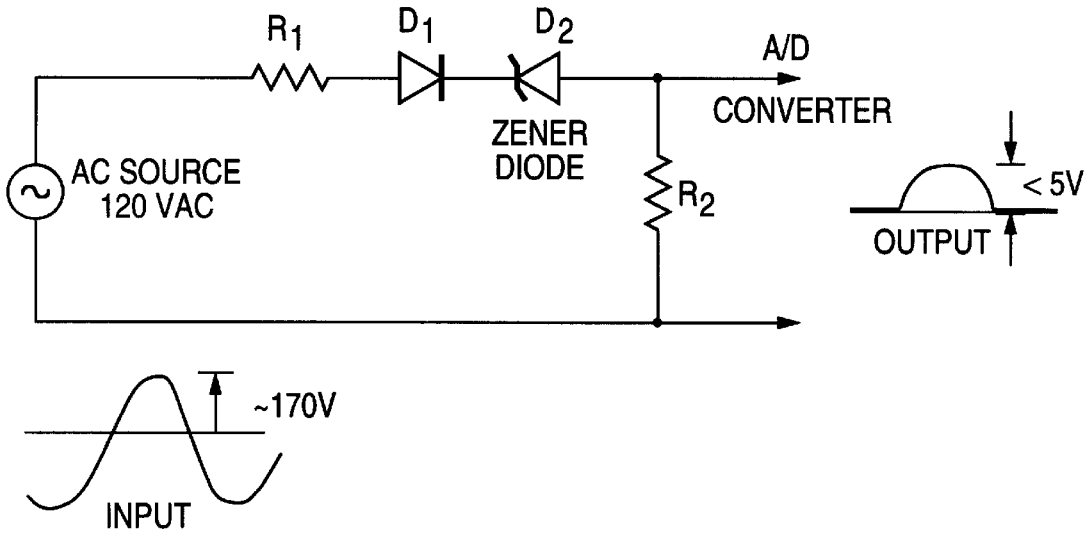
FIG. 13 is a schematic diagram showing a sample circuit for monitoring line voltage.
Figure 14:
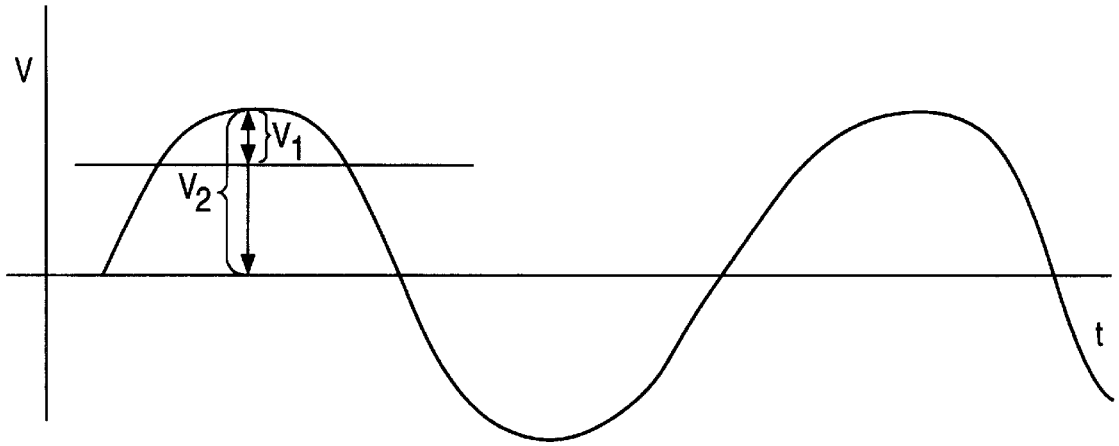
FIG. 14 is graph of line voltage over time illustrating the portion of the voltage curve that is preferably monitored using the circuit of FIG. 13.

A sample circuit for monitoring voltage variations is shown in FIG. 13. The circuit utilizes a Zener diode and a resistor divider which monitor the upper portions of the voltage peaks and feed the measured voltages into an A/D converter. For example, referring to FIG. 14 which shows a plot of AC line voltage over time, the region labeled V1 is monitored by the circuit. By only monitoring the upper portion of the voltage curve, the circuit allows for very good line voltage resolution using only an 8 bit A/D converter. An average line voltage is preferably obtained over approximately 20 cycles. The circuit of FIG. 13 may alternatively be configured to eliminate the Zener diode and to replace it with a straight wire or zero ohm resistor. If such a modification is made, the circuit will monitor region labeled V2 on the FIG. 14 curve.

It may instead be desirable to perform the compensation based on measured current through the lamps rather than based on line voltage. By measuring current fluctuations, compensation could be used to compensate not only for line voltage fluctuations, but also for additional factors such as the increased resistance that occurs in the electrical components, connectors, and lamps as they age. This may be done, for example, using a transformer wire wound around the AC line, or by converting a small amount of current into heat and obtaining an averaged value of the heat output, or using a resistor placed in series with one of the cooking lamps and measuring the voltage across the resistor.

Figure 15:
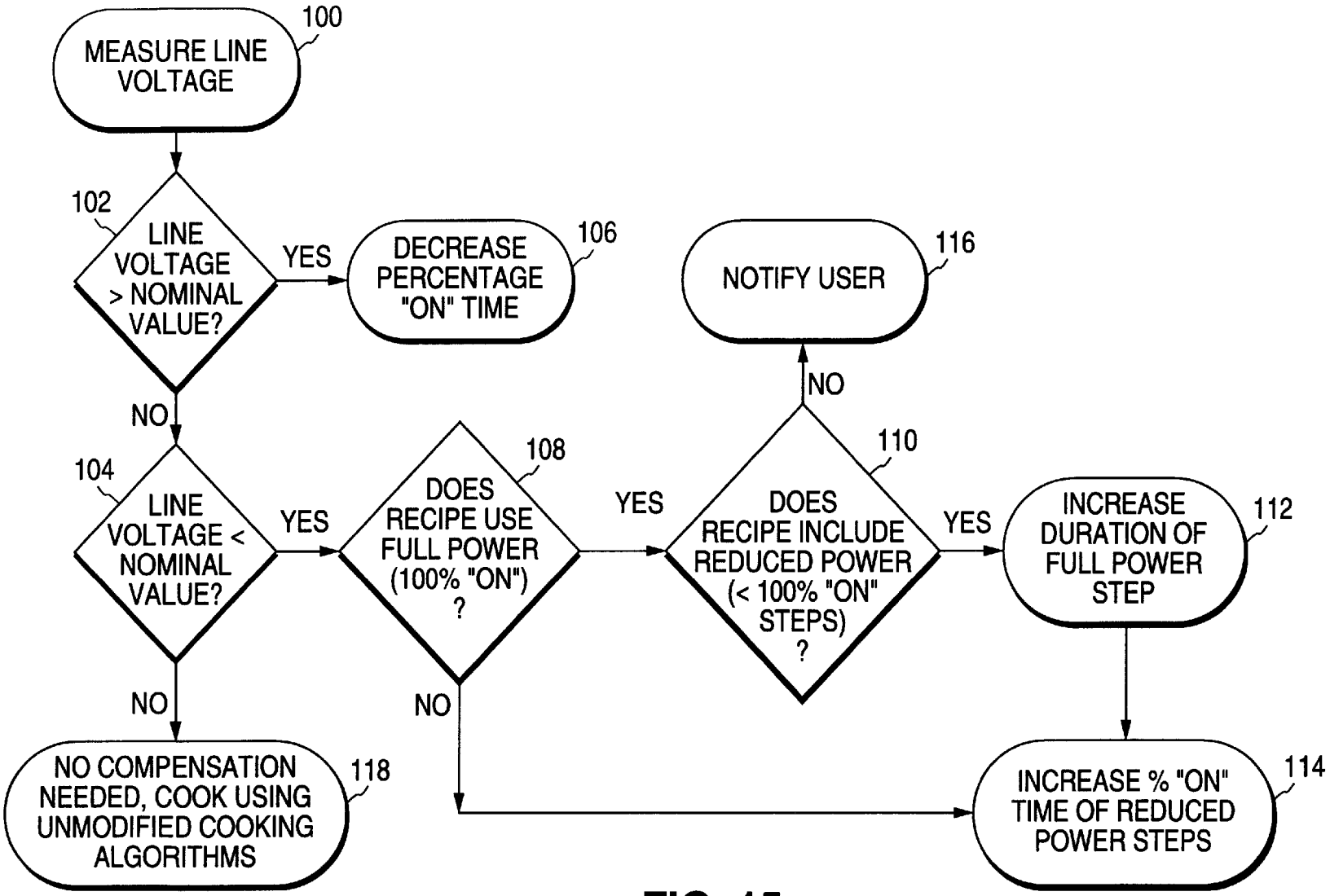
FIG. 15 is a block diagram illustrating operation of the line voltage compensation algorithm according to line voltage compensation scheme.

FIG. 15 is a block diagram illustrating the voltage compensation algorithm. At the start of a cooking cycle, the line voltage (or current) is monitored as described above and compared to a predetermined nominal lamp voltage. Steps 100, 102, 104. For a 240V lightwave oven such as oven 100, a voltage of 230V is chosen as the nominal lamp voltage for purposes of compensation. This nominal voltage was chosen because in many homes line voltage ranges from approximately 232 V to 240V. Normalizing oven performance to a line voltage slightly below this range insures that most variations in line voltage will fall above the nominal voltage and can thus be compensated for by reducing the duty cycle of the lamps. Because in a 240V oven a large amount of lamp power (typically at least 4 kW) is available for use by the lamps, the duty cycle may be increased to compensate for line variations below the nominal voltage. It should be noted that because the 120V oven 201 utilizes only approximately 1.8 kW power, less power is available for use in compensating upwardly for line variations. Thus, the nominal lamp voltage for oven 201 would preferably be chosen to be closer to 120V.

Once the line voltage is determined and compared against the nominal line voltage, the compensation algorithm adjusts the lamp "on" time upwardly or downwardly as needed. If the monitored line voltage is greater than the nominal lamp voltage, the lamp "on" times are adjusted so that the averaged lamp power is not affected by the change in lamp voltage. Steps 102, 106. This may be done by modifying the duty cycle to decrease the percentage "on" time, or by dropping an appropriate percentage of the "on" cycles to insure that the same power is used as would have been used if the line voltage was at the nominal voltage. Note that the overall start-to-finish cooking time is preferably not adjusted to compensate for line voltage.

If the monitored line voltage is lower than the nominal lamp voltage, the duty cycle will be altered to increase the percentage "on" time or to add an appropriate number of cycles so that cooking power is unaffected by the low line voltage. Step 114. However, this type of modification to the cooking power cannot be performed if a low line voltage condition is detected during a cooking sequence in which the oven is being run at full power (i.e., 100% "on" time). Nevertheless, compensation may be still be performed if the cooking mode being utilized is a multi-step mode, including one in which the power ramps down or steps down after the maximum power step of the recipe. See, for example, the autopulse mode described above or the cooking modes described in International Appl. PCT/US94/12396 entitled APPARATUS AND METHOD OF COOKING IN A LIGHTWAVE OVEN. Thus, if a low line voltage condition is detected during a cooking mode which utilizes a full power step followed by one or more reduced power steps, the duration of the full power step is extended so that the average lamp power throughout the entire recipe is kept constant. Steps 108, 110, 112. For the subsequent reduced-power steps in the cooking algorithm, compensation is performed by increasing the percentage "on" time as described above. Step 114.

On the other hand, if the cooking recipe is one which utilizes full power (100% "on" time) for the entire during of the recipe, the user is notified using a visual and/or auditory signal so that s/he can elect to extend the cooking duration as needed. Steps 110, 116. The oven may alternatively be programmed to automatically extend the start-to-finish cooking time in this instance, although this may not be desirable to some users.

If the line voltage approximately equals the nominal voltage, the cooking recipe/algorithm is not modified to compensate for line voltage. Step 118.

In one form of the invention, look-up tables stored in the system software include scaling factors to be applied to the percentage "on" times for line voltage values above and below the nominal voltage to achieve the increases or reductions in "on" time called for in Steps 106, 112 and 114. Alternatively, the software may include line-voltage-compensated recipes for each of the cooking modes and for each of the line voltage values falling above and below the nominal value.

We claim:

1. A cooking method utilizing compensation for variations in line voltage, comprising the steps of:

(a) providing an oven having a radiant energy source mounted therein, the radiant energy source electrically coupled to a line voltage source;

(b) initiating a selected cooking cycle in the oven, the cooking cycle having a predetermined cooking duration and a predetermined energization time for the radiant energy source;

(c) measuring the line voltage from the line voltage source, and determining the increase or decrease in the line voltage above or below a predetermined nominal value; and (d) determining an adjusted energization time relative to the predetermined energization time, using the determined increase or decrease in line voltage; and (e) completing the cooking cycle approximately within the predetermined cooking duration using the adjusted energization time.

2. The cooking method according to claim 1 wherein in step (b) the cooking cycle includes a predetermined average power level for the radiant energy source, and wherein step (d) includes completing the cooking cycle using approximately the predetermined average power.

3. The cooking method according to claim 1 wherein the cooking cycle initiated in step (b) includes a duty cycle, wherein step (d) includes determining an adjusted duty cycle to achieve the adjusted energization time, and wherein step (d) includes using the adjusted duty cycle.

4. The cooking method according to claim 1 wherein the radiant energy source is a lightwave cooking lamp.

5. The cooking method according to claim 4 wherein the measuring step in step (c) includes measuring a voltage across the lamp.

6. The cooking method according to claim 4 wherein the measuring step in step (c) includes measuring the current through the lamp.

7. A cooking method utilizing compensation for variations in line voltage, comprising the steps of:

(a) providing an oven having a cooking lamp mounted therein;

(b) initiating a selected cooking cycle in the oven, the cooking cycle having a predetermined energization time for the lamp, a predetermined average cooking power, and a predetermined cooking duration;

(c) measuring the line voltage across the lamp, and determining the increase or decrease in the line voltage above or below a predetermined nominal value; and (d) selecting an adjusted energization time, using the determined increase or decrease in line voltage, the adjusted energization time being selected to approximately achieve the predetermined average cooking power over the predetermined cooking duration; and (e) completing the cooking cycle in approximately the predetermined cooking duration using the adjusted energization time.

8. The cooking method of claim 7 wherein the cooking lamp is a lightwave cooking lamp.

9. The cooking method of claim 7 wherein the measuring step of step (c) is carried out by measuring the current through the lamp and calculating the line voltage from the measured current.

10. A lightwave oven for use in cooking food, comprising:

an oven housing enclosing a cooking region therein;

at least one high power lamp within the oven housing that provides radiant energy in the visible, near-visible and infrared ranges of the electromagnetic spectrum to the cooking region;

a line voltage detector ciruit; and a controller for initiating a selected cooking cycle in the oven, the cooking cycle having a predetermined energization time for the lamp, a predetermined average cooking power, and a predetermined cooking duration, for receiving a signal representing a line voltage detected by the voltage detector circuit, for selecting an adjusted energization time for the lamp based on the received signal, and for causing the lamp to be energized for the adjusted energization time so as to approximately achieve the predetermined average cooking power over the predetermined cooking duration.

* * * * *

UNITED STATES PATENT AND TRADEMARK OFFICE

CERTIFICATE OF CORRECTION

PATENT NO. : 6,232,582 B1 
DATED : May 15, 2001
INVENTOR(S) : William Minnear, John O Neill, Chris Tartarian and Don Pettibone It is certified that error appears in the above-identified patent and that said Letters Patent is hereby corrected as shown below:

Title page,
Inventor "John O'Neal's" name is misspelled. Please amend to read
-- John O'Neill --

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,232,582 B1 
DATED : May 15, 2001
INVENTOR(S) : William Minnear et al.

It is certified that error appears in the above-identified patent and that said Letters Patent is hereby corrected as shown below:

Title page,
Item [75], inventor named "John O'Neill" is misspelled. Please amend to read
-- John O'Neal --

Signed and Sealed this

Eighteenth Day of February, 2003

JAMES E. ROGAN
*Director of the United States Patent and Trademark Office*